US005603127A

United States Patent [19]

Veal

[11] Patent Number: 5,603,127

[45] Date of Patent: Feb. 18, 1997

[54] AUTO FLUSH FOR TANK TOILET

[76] Inventor: Bennie N. Veal, 6621 Park Valley Dr., Clarkston, Mich. 48348

[21] Appl. No.: 550,509

[22] Filed: Oct. 30, 1995

Related U.S. Application Data

[63] Continuation of Ser. No. 55,212, filed as PCT/US94/04841, Apr. 29, 1994, Pat. No. 5,307,524, which is a continuation-in-part of Ser. No. 857,462, Mar. 25, 1992, abandoned.

[51] Int. Cl.[6] ..... A47K 13/10; E03D 5/10

[52] U.S. Cl. ..... 4/246.1; 4/313; 4/DIG. 3; 4/246.2

[58] Field of Search ..... 4/313, 406, 246.1, 4/246.2, 249, 250, DIG. 3

[56] References Cited

U.S. PATENT DOCUMENTS

| | | | |
|---|---|---|---|
| 2,219,044 | 10/1940 | Horr . | |
| 2,440,231 | 4/1948 | Davidson . | |
| 3,284,810 | 11/1966 | Stokes . | |
| 3,404,411 | 10/1968 | Newkirk . | |
| 3,559,217 | 2/1971 | Johnson | 4/406 |
| 4,185,336 | 1/1980 | Young . | |
| 4,338,690 | 7/1982 | Hsieh et al. | 4/313 |
| 4,392,260 | 7/1983 | Bensen | 4/DIG. 3 |
| 4,459,521 | 7/1984 | Barge . | |
| 4,935,967 | 6/1990 | Cour . | |
| 4,941,215 | 7/1990 | Liu | 4/DIG. 3 |
| 4,989,277 | 2/1991 | Tsutsui et al. . | |
| 4,995,120 | 2/1991 | Tager . | |
| 5,003,643 | 4/1991 | Chung | 4/313 |
| 5,036,443 | 7/1991 | Humble et al. . | |
| 5,036,553 | 8/1991 | Sanderson . | |
| 5,153,946 | 10/1992 | Yoke et al. . | |
| 5,187,818 | 2/1993 | Barrett, Sr. et al. . | |
| 5,307,524 | 5/1994 | Veal . | |

FOREIGN PATENT DOCUMENTS 1054306 5/1979 Canada .

OTHER PUBLICATIONS

Young, Renee, "Advances in Electronic Plumbing," *PMEngineer*, pp. 28–36, Oct., 1995.

Zurn Industries, Inc. Specification Data Sheet, "Aquaflush Flush Valve with On–Demand Sensor Actuation," Brochure.

Zurn Aquaflush Sensor . . . A New Era in Automatic Sensor Flush Valves, Brochure.

Zurn RetroFlush, Sensor–Operated Retrofit Flush Valve Kit Battery Powered, Brochure, Nov., 1993.

Zurn, All Metal Construction RetroFlush, Brochure.

"A device That's Likely to Please Everyone," *The New York Times*, Consumer's World, Feb. 15, 1992.

Specification Sheet, Optima Systems Royal 152 ES–S, Sloan Valve Company.

Advertisement, Innsbrook, American Standard, 1994.

*Primary Examiner*—Henry J. Recla
*Assistant Examiner*—Charles R. Eloshway
*Attorney, Agent, or Firm*—Harness, Dickey & Pierce, P.L.C.

[57] ABSTRACT

An automatic flushing system for a tank-type toilet. The automatic flushing system includes one or more infrared transmitters that transmit an infrared signal to a sensing area directly in front of a toilet bowl of the toilet. The presence of a user in the sensing area is detected by the system from a reflection of the transmitted infrared beam off of the user. Detection of the user in the sensing area for a predetermined minimal period of time causes an automatic courtesy flush. Once the user has left the sensing area, the automatic flushing system will provide a main flush. The automatic flushing system includes a lift arm operated by a flush motor positioned within the toilet tank. Activation of the motor causes the lift arm to push against a flush arm in the toilet tank to flush the toilet. The lift arm is positioned beneath the flush arm to allow for manual flushing.

21 Claims, 15 Drawing Sheets

AUTO FLUSH FOR TANK TOILET

CROSS-RELATED APPLICATIONS

This application is a continuation-in-part application of PCT application PCT/US94/04841, filed Apr. 29, 1994, which is a continuation of Ser. No. 08/055,212, now U.S. Pat. No. 5,307,524 issued May 3, 1994 which is a continuation-in-part application of U.S. application Ser. No. 07/857,462, filed Mar. 25, 1992, now abandoned.

BACKGROUND OF THE INVENTION

1. Field of the Invention

This invention relates generally to an automatic flushing system for a toilet and, more particularly, to an automatic flushing system for a tank-type toilet that utilizes infrared radiation beam sensors, and is used in conjunction with an automatic toilet seat raising and lowering device.

2. Discussion of the Related Art

For various and well understood reasons, such as the passage of germs that could lead to sickness, it is generally desirable to be able to use a toilet without touching the toilet or touching the toilet as little as possible, especially for toilets in public facilities. One way in which the need to make physical contact with a toilet has been reduced is the incorporation of automatic flushing systems. Not only do automatic flushing systems reduce physical contact with the toilet, these systems also reduce problems such as user abuse, odor, unflushed fixtures, excessive water consumption, and the like.

One type of known automatic flushing system for public facilities is available from ZURN Industries of Sanford, N.C. The ZURN flushing system uses an infrared transmitter and detector to sense the presence of a user so as to automatically flush the toilet after the user has been sensed, and has left the area immediately in front of the toilet bowl. The ZURN automatic flushing system provides a number of features that make it a valuable system for limiting physical contact with the toilet. These features include a courtesy flush immediately after a user is detected so as to freshen the bowl and remove residue from the fixture. The main flush follows after the user has moved away from the fixture. The courtesy flush can be manually switched on or off. Other features include an adjustable detection range, operation indicator lights, and a maintenance override system.

Other known features for toilets also reduce the amount of physical contact necessary with the toilet. U.S. Pat. No. 5,307,524 issued to Veal, assigned to the assignee of the instant invention, and herein incorporated by reference, discloses a toilet seat device that automatically causes a toilet seat to be either raised or lowered in response to a switching mechanism. The automatic toilet seat device includes a float switch within the tank of the toilet that causes the toilet seat to automatically be lowered when the float switch is activated by the flushing action of the toilet. The automatic raising and lowering of the toilet seat allows the toilet seat to be raised and lowered without actually being contacted by the user.

Improvements can be made to known automatic flushing systems to extend them to tank-type toilets, and automatic flushing systems that operate in conjunction with an automatic toilet seat activating device to further lessen contact with the toilet. It is one object of the present invention to provide such an automatic flushing system.

SUMMARY OF THE INVENTION

In accordance with the teachings of the present invention, an automatic flushing system for use in conjunction with a tank-type toilet is disclosed. The automatic flushing system includes one or more infrared transmitters that transmit an infrared signal to a sensing area directly in front of a toilet bowl of the toilet. The presence of a user in the sensing area is detected by the system from a reflection of the transmitted infrared beam off of the user. In one embodiment, detection of the user in the sensing area for a predetermined minimal period of time causes an automatic courtesy flush to remove residue from the fixture prior to use by the user. Once the user has left the sensing area, the automatic flushing system will provide a main flush.

The automatic flushing system includes a lift arm operated by a flush motor positioned within the toilet tank. Activation of the motor causes the lift arm to push against a flush arm in the toilet tank to flush the toilet. The lift arm is positioned beneath the flush arm to allow for manual flushing of the toilet. The travel of the lift arm can be adjusted to accommodate different flush arms associated with different toilet tanks. Further, the automatic flushing system includes a control circuit that is electrically connected to a float switch secured within the toilet tank. The float switch provides an indication to the control circuit of a manual flush. The control circuit includes a digital display that gives an indication of the operation of the system.

Additional objects, advantages, and features of the present invention will become apparent from the following description and appended claims, taken in conjunction with the accompanying drawings.

DETAILED DESCRIPTION OF THE PREFERRED EMBODIMENTS

The following discussion of the preferred embodiments concerning an automatic toilet seat raising and lowering device is merely exemplary in nature and is in no way intended to limit the invention or its application or uses.

Figure 1:
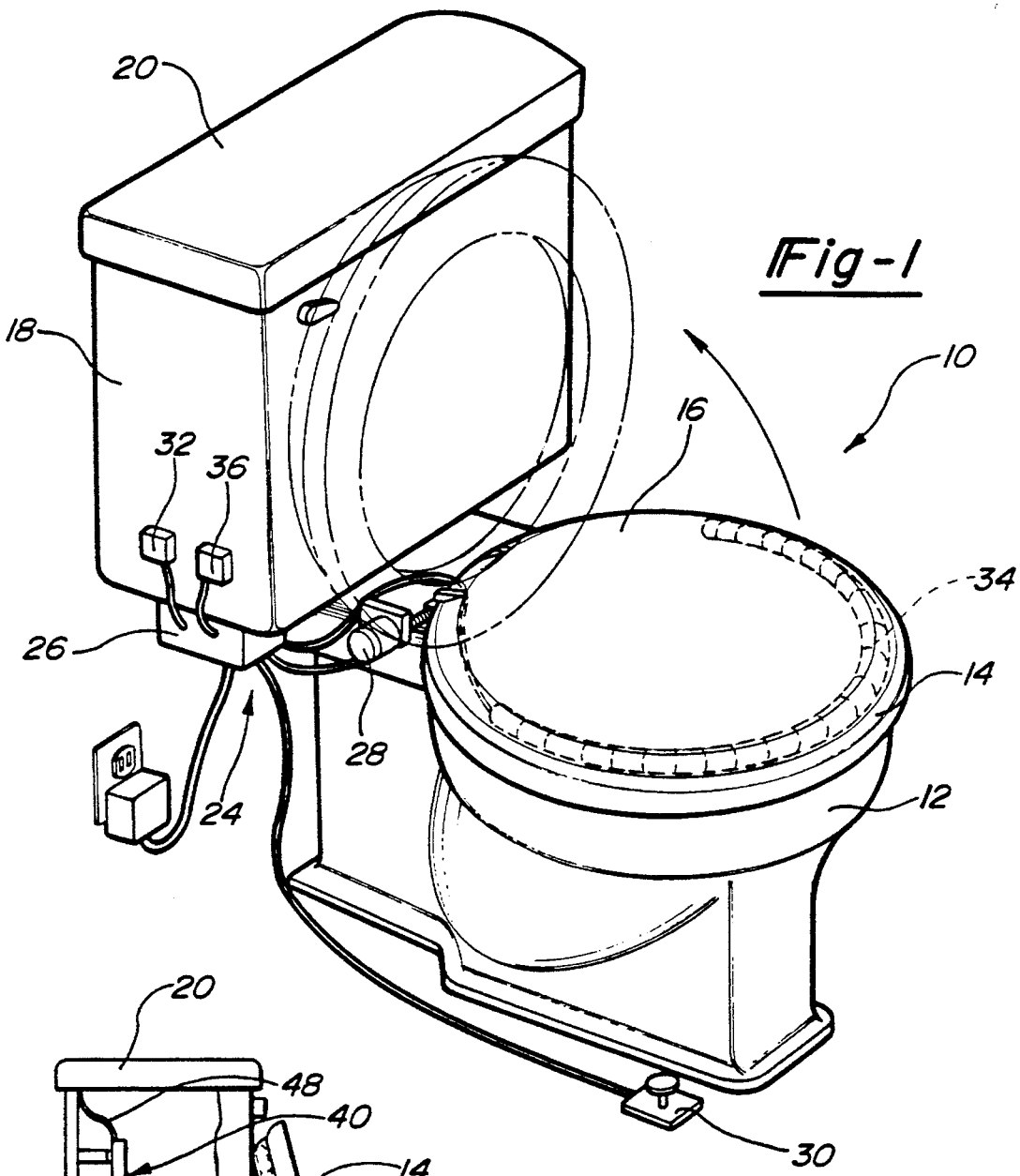
FIG. 1 is a perspective view of a toilet incorporating an automatic toilet seat device according to one embodiment of the present invention.
Figure 2:
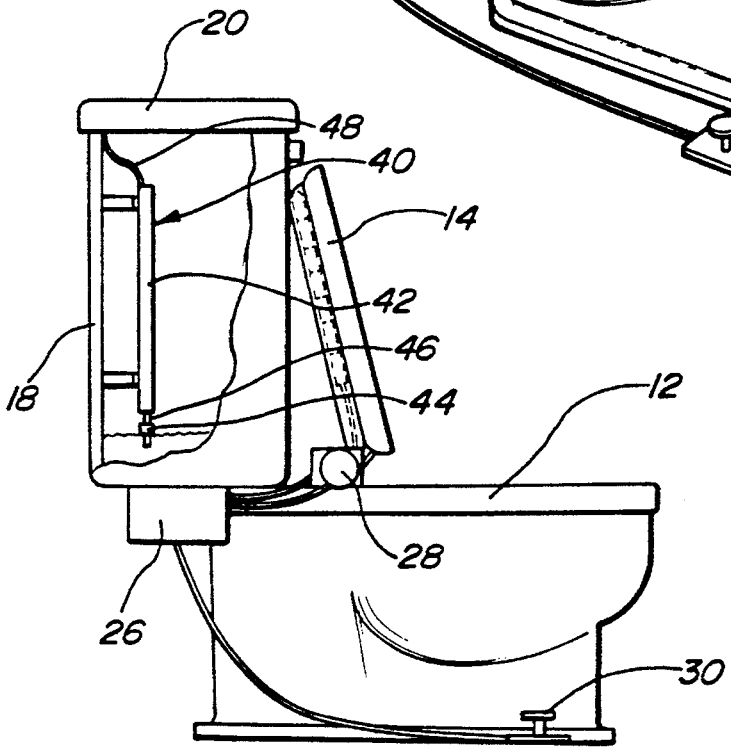
FIG. 2 is a side view of the toilet incorporating the toilet seat device of FIG. 1.

Referring to FIGS. 1 and 2, a toilet 10 is shown including the traditional toilet components of a toilet bowl 12, a toilet seat 14, a toilet bowl lid 16 and a toilet tank 18 having a toilet tank lid 20. The toilet seat 14 and the toilet bowl lid 16 are connected to the toilet bowl 12 in a known manner such that the seat 14 and the lid 16 can articulate relative to the toilet bowl 12 between a raised and lowered position, as is well understood. The toilet seat 14 and the toilet bowl lid 16 are shown in the lowered position, and are further shown in the raised position in phantom. The operation and structural aspects of the toilet 10 can be of any manner known, and thus, these aspects need not be elaborated on here.

According to a preferred embodiment of the present invention, the toilet 10 includes an automatic toilet seat device 24. The toilet seat device 24 includes a control circuit 26, shown here as an electrical box for housing electrical circuitry, and further shown being attached by any suitable means to an undersurface of the toilet tank 18. The toilet seat device 24 further includes an electric motor 28 and a push button switch 30, both being electrically connected to the control circuit 26 by electrical wires, as shown. It will be understood that the control circuit 26 can be of varying sizes and shapes to be in conformity with the electrical circuitry used, and can further be attached to any desirable location on the toilet 10 or a structure adjacent to the toilet 10. The control circuit 26 preferably operates on 12 volts DC, and may include a self contained power source or be operable to convert 120 volts AC from a standard outlet. As shown in FIG. 1, the control circuit 26 receives power from a standard outlet via a step-down transformer.

As will be discussed with specific detail below, the electric motor 28 is operable to either raise or lower the toilet seat 14 depending on an electrical control signal from the control circuit 26. The electric motor 28 can be any suitable motor, preferably being as small as possible to accomplish the desired task. One specific applicable motor is a Dayton 1/200 hp, model YZ835 having a 580:1 gear ratio. The electric motor 28 is operable to rotate in either direction depending on the polarity of the electrical signal from the control circuit 26. A tandem configuration of switches (see FIGS. 3 and 5) is utilized to instruct the control circuit 26 what position the toilet seat 14 is in, and thus, in which direction to rotate the shaft of the motor 28.

The switch 30 will provide an electrical signal to the control circuit 26 in order to instruct the electric motor 28 to either raise or lower the toilet seat 14 depending on its present position. If the toilet seat 14 is in a lowered position, a push of the switch 30 will raise the seat 14, but if the seat 14 is in a raised position, a push of the switch 30 will lower the seat 14. A dual configuration of switches, one to raise the seat 14 and one to lower the seat 14, could also be used. The switch 30 is shown here as a push button floor switch positioned proximate to the toilet bowl 12, but can be incorporated in any desirable location, such as on a wall proximate to the entrance to a bathroom including the toilet 10. Additionally, the switch 30 can be incorporated as part of a remote switch for use in a wireless manner.

If desirable, a sound activated device 32 may be incorporated to either raise or lower the toilet seat 14 by generating an acoustical signal of appropriate intensity and frequency. Such sound activated devices are well known in the art. The sound activated device 32 is shown attached to a side of the toilet tank 18 by any appropriate means, but can be attached at any desirable location on or proximate to the toilet 10. Additionally, the sound activated device 32 is electrically connected to the control circuit 26. By providing the necessary acoustical signal, such as could be accomplished by clapping of the hands, the toilet seat 14 will be either raised or lowered, depending on the manner in which the device 32 is incorporated into the control circuit 26.

The toilet seat device 24 is further operable to lower the toilet seat 14 after the toilet 10 has been flushed. In FIG. 2, the toilet tank 18 is shown partially cut away to expose a float switch 40. The traditional toilet components within the tank 18 are not shown. The float switch 40 includes a tubular portion 42 and a floatable portion 44 which is floatable on the surface of the water within the tank 18 along a shaft 46 only when the water level is below a bottom surface of the tubular portion 42. In other words, once the floatable portion 44 contacts the bottom of the tubular portion 42 and is submerged underwater, it is pinned in this location due to its buoyancy. After the toilet 10 has been flushed, the floatable portion 44 will drop to its lowest level in association with the water level in the tank 18. Once the floatable portion 44 separates from the tubular portion 42 in association with the water in the tank 18, a switch (not shown) within the tubular portion 42 is disengaged. The switch will then send a signal to the control circuit 26 via electrical wires 48 to indicate that the toilet 10 has been flushed. Alternately, the signal can be sent when the floatable portion 44 recontacts the tubular portion 42 after the water level rises. The toilet seat 14 and the toilet lid 16 are shown in a raised position in FIG. 3 even though the water level is indicating a flush has occurred because there is a small delay between the time the switch sends the signal and the time the seat 14 is lowered.

The toilet lid 16 includes an illumination source 34, shown here as an elongated tubular light held in position within an outer covering material of the toilet lid 16. The outer covering is substantially translucent to enable the light to escape. In a preferred embodiment the illumination source 34 is a flex light manufactured by National Specialty Lighting operable to be run on 12 VDC at 0.28 watts and having a diameter of approximately 0.5 inches. Preferably, the illumination source 34 will be associated with one of either the toilet lid 16 or the toilet seat 14. It will be understood, however, that the illumination source 34 can be located in any desirable position, and further, can be of any desirable shape. The illumination source 34 will preferably include some type of photosensitive cell 36 in order to switch on the illumination source 34 at the appropriate time, i.e. when the toilet area is sufficiently dark. The photosensitive cell 36 is depicted here as being attached to the toilet tank 18, by any appropriate means, but also can be attached at any desirable location. The illumination source 34 is operable to run on the 12 volt DC power from the control circuit 26, as will be discussed below, or can be operable to run on a separate AC source.

Figure 3:
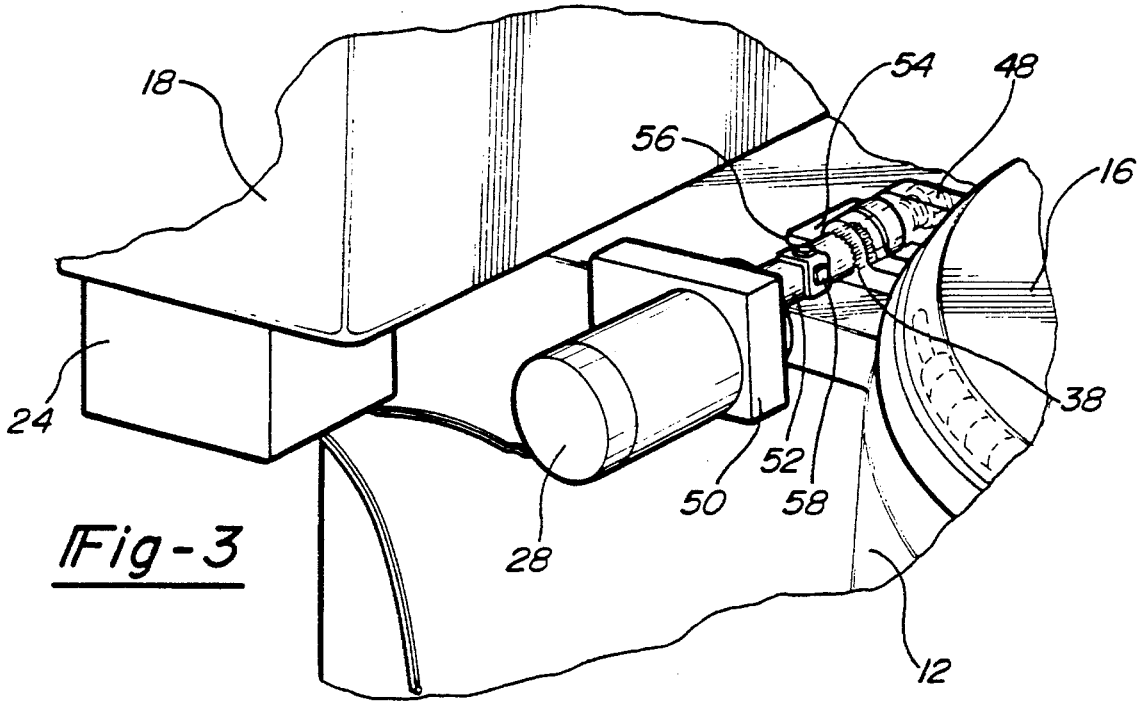
FIG. 3 is a close-up perspective view of the toilet seat device of FIG. 1.

Now turning to FIG. 3, a close-up perspective view of the toilet seat device 24 is shown. As shown, the electrical motor 28 includes a gear box 50 and a motor shaft 52. The shaft 52 extends from the gear box 50 and is engagable with a connecting section 54 of the toilet seat 14 at a point substantially where the toilet seat 14 articulates relative to the toilet bowl 12. In a preferred arrangement, a bolt 48 extends through the connecting section 54 substantially along an axis of the shaft 52 such that extension spleens 38 extending from the shaft 52 engage both the bolt 48 and the connecting section 54 as shown. The method of connection between the shaft 52 and the connecting section 54, however, can be of any suitable method such that the toilet seat 14 is rotated on an articulation axis upon rotation of the shaft 52. All of the components included as part of the electrical motor 28, the gear box 50 and the shaft 52 can be incorporated within a common housing (not shown) or on a common platform (not shown).

Additionally, two limit switches 56 and 58 are shown positioned at substantially 90° to each other on the shaft 52. The limit switches 56 and 58 can be any appropriate limit switches known in the art such as mercury switches, etc. The limit switches 56 and 58 will be electrically connected to the control circuit 26 by means of wires (not shown). The operation of the switches 56 and 58 is known in the art, and as used here provides an indication as to the position of the shaft 52. In other words, when the shaft 52 is rotated, one of the switches 56 or 58 will be closed while the other will be opened. Thus, when the toilet seat 14 is in a raised position the limit switch 56 will be closed, and when the toilet seat 14 is in a lowered position the limit switch 58 will be closed. Consequently, the control circuit 26 will know in what position the toilet seat 14 is in, whether raised or lowered. It is noted that in this specific arrangement, the toilet seat 14 and the toilet bowl lid 16 will be raised together by the motor 28, but only the toilet seat 14 will be lowered by the motor 28. Additionally, a clutch mechanism (see FIG. 6) can be incorporated in order to enable the toilet seat 14 to be raised or lowered manually when the mechanism is attached to the shaft 52 of the electric motor 28.

Now turning to FIG. 4, a detailed discussion of the operation of the toilet seat device 24 set forth above will be given with specific reference to an electrical circuit 68. The electrical circuit 68 can be separated into five distinct electrical circuits operating off a common power supply 72. Specifically, those circuits are a motor circuit 76, an acoustical circuit 70, an illumination circuit 78, a seat raising circuit 80, and a seat lowering circuit 82. Each of these circuits makes up a substantial portion of the control circuit 26, above. Upon closing of a master switch 74, each of these circuits will receive power from the power source 72. The power source 72 may be housed with control circuit 26 and as such can be any applicable 12 volt DC power source, as discussed above, but is shown here receiving a 120 volt AC signal from a standard outlet.

Specifically referring to the illumination circuit 78, the components and operation of this circuit will be discussed first. The circuit 78 is generally separate from the operation of the remaining circuits 70, 76, 80 and 82. The circuit 78 includes a photosensitive cell 84 and an illumination source 86, each connected in series with a load resistor $R_L$. The photosensitive cell 84 is analogous to the photosensitive cell 36 and the illumination source 86 is analogous to the illumination source 34, above. The photosensitive cell 84 can be any known cell which will be sensitive to ambient light, and will further close an electrical connection when the ambient light diminishes below a predetermined intensity level, as is well known in the art. Assuming the master switch 74 is in a closed position and the ambient light is sufficiently low, electric current will then reach the illumination source 86 from the power supply 72 such that it will be ignited. It is noted that a separate switch, other than the master switch 74, can be incorporated within the circuit 78 such that the operation of the illumination circuit 78 can be controlled separately from the remaining circuits. Alternately, the photosensitive cell 84 can be removed such that the illumination source 86 is operated merely by a manual switch.

The acoustical circuit 70 includes an E-relay coil 62 electrically connected in series with a sound activated device 64. The sound activated device 64 is analogous to the sound activated device 32 above and is operable to close a contact upon receiving an acoustical signal of a frequency and intensity within a specific range. Sound activated devices of this type are known in the art and as such need not be discussed in detail here. Assuming the master switch 74 is in a closed position and the sound activated device 64 receives an appropriate acoustical signal, the E-relay coil 62 will be energized which will in turn close a set of E-relay contacts 66 associated with the seat lowering circuit 82. The closing of the E-relay contacts 66 is thus operable to lower the toilet seat 14, as will be discussed in greater detail below. It is noted, however, that the E-relay contacts 66 can also be included in the seat raising circuit 80 in order to raise the seat 14 at the initiation of a desirable acoustical signal.

The motor circuit 76 includes switch contacts 88 of a double pole double throw D-relay, normally open B-relay holding contacts 90, and an electrical motor 92. The motor 92 is analogous to the electrical motor 28, above. Since the motor 92 must rotate in both directions in order to raise and lower the toilet seat 14, the switch contacts 88 of the D-relay provides a mechanism by which the polarity of the power supply 72 can be reversibly applied to the motor 92 to cause it to rotate in alternate directions. More particularly, when the motor 92 is to be rotated in one direction, the positive and negative inputs must be applied to one side of the motor 92, and when the motor 92 is to be rotated in the opposite direction, the polarity must be reversed. The switch contacts 88 of the D-relay are shown in their normal unenergized position such that if the holding contacts 90 were closed, the motor 92 would receive power to rotate the motor 92 to raise the toilet seat 14. When the contacts 88 are switched, the polarity is reversed, and the motor 92 will rotate to lower the toilet seat 14.

The seat raising circuit 80 includes a push button switch 100, analogous to the switch 30, above, connected in series with a normally closed C-relay interlock 94, an A-relay coil 102, a B-relay coil 104 and a seat lowered switch 106, analogous to the limit switch 58, above. Additionally, the A-relay coil 102 and the B-relay coil 104 are connected in parallel, and a set of normally open A-relay holding contacts 108 are connected in parallel with the switch 100. If both the master switch 74 and the seat lowered switch 106 are in closed positions, and the push button switch 100 is depressed, both of the coils 102 and 104 will be energized. Additionally, the contacts 108 and 90 will be closed, thus maintaining both the A-relay coil 102 and the B-relay coil 104 energized and enabling the motor 92 to raise the toilet seat 14. Furthermore, a normally closed A-relay interlock 124 is opened, thus disabling the seat lowering circuit 82. If, however, the switch 106 is open (indicating that the seat 14 is already up), the A-relay coil 102 and the B-relay coil 104 will not be energized regardless if the push button switch 100 is depressed. Thus the motor 92 will not attempt to raise the toilet seat 14. When the toilet seat 14 reaches its raised position, the switch 106 will be opened thus deenergizing the A-relay coil 102 and the B-relay coil 104, and opening the contacts 108 and 90 causing the motor 92 to stop rotating. Furthermore, once the toilet seat 14 reaches its raised position, a seat raised switch 116 will be closed, but the push button 30 will be open, and thus, the seat 14 will not be lowered.

The seat lowering circuit 82 also includes a push button switch 110, analogous to the switch 30, above, positioned in series with the normally closed A-relay interlock 124, a C-relay coil 112, a D-relay coil 114 and the seat raised switch 116. Additionally, positioned in parallel with the push button switch 110, is a float switch 118, analogous to the float switch 40, above, a set of normally open C-relay holding contacts 120 associated with the C-relay coil 112, the E-relay contacts 66, and an optional timing circuit 122. Assuming that the master switch 74 and the switch 116 are closed, and either push button switch 110 is depressed or the float switch 118 is closed, the C-relay coil 112 and the D-relay coil 114 will be energized such that the C-relay contacts 120 will be closed in order to maintain power to the C-relay coil 112 and the D-relay coil 114. When the D-relay coil 114 is energized, the contact switches 88 associated with the D-relay are switched causing the polarity of the motor 92 to be reversed, and thus, lowering the toilet seat 14. Furthermore, the interlock 94 is opened, thus disabling the seat raising circuit 80. When the toilet seat 14 reaches its lowered position, the switch 116 will be opened, thus deenergizing the C-relay coil 112 and the D-relay coil 114 causing the motor 92 to stop rotating.

Figure 4:
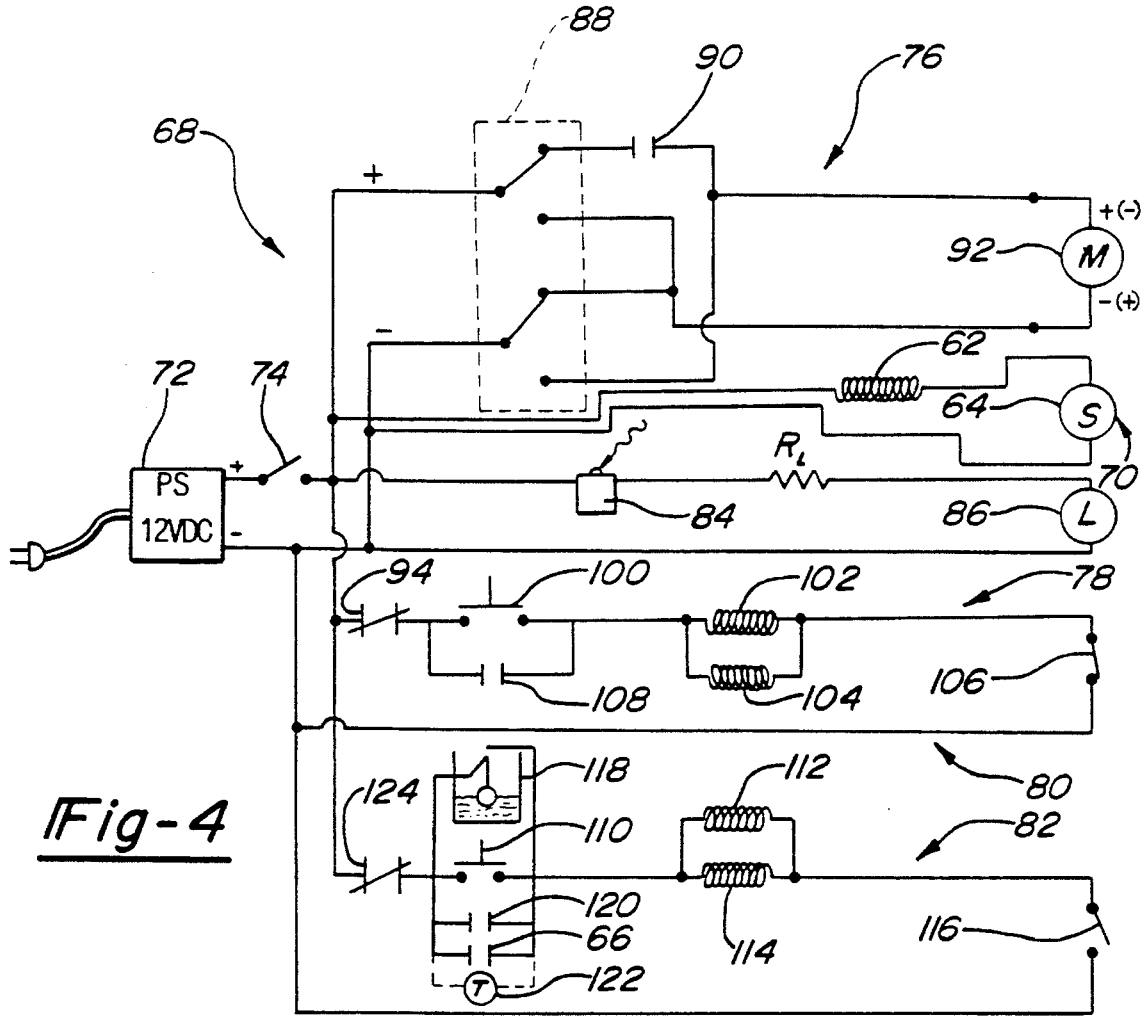
FIG. 4 is a circuit diagram of the operation of the automatic toilet seat device according to one embodiment of the present invention.

The circuit configuration of FIG. 4 as shown depicts the toilet seat 14 in a lowered position. Assuming that the master switch 74 is then closed and a user wishes to raise the toilet seat 14, the user will depress the switch 30 which will activate the push button switches 100 and 110. If the toilet seat 14 is indeed in a lowered position, the switch 106 will be closed, and thus, both the A-relay coil 102 and the B-relay coil 104 will be energized causing the normally open contacts 90 and 108 to close and the normally closed interlock 124 to open. Because the normally closed interlock 124 is opened, and because the switch 116 is open, the C-relay coil 112 and the D-relay coil 114 will not be energized. Consequently, power will be applied to the motor 92 in the proper polarity such that the shaft 52 of the motor 28 will rotate in a clockwise direction, thus raising the toilet seat 14.

Once the toilet seat 14 reaches its upright position, the switch 106 will be opened and the switch 116 will have already been closed. Accordingly, if the user then desires to return the seat 14 to its lowered position, he can again depress the switch 30, closing the switch 110, such that the C-relay coil 112 and the D-relay coil 114 are energized, closing the C-relay contacts 120, opening the interlock 94 and switching the D-relay switches 88, thus reversing the polarity of the motor 92 in order to lower the toilet seat 14. Because the switch 106 is open when the toilet seat 14 is in a raised position and the interlock 94 is open, the A-relay coil 102 and the B-relay coil 104 will not be energized. Additionally, the user can activate the sound device 64 by clapping his or her hands, or performing some other appropriate sound.

If, however, the user does not return the toilet seat 14 to its lowered position by depressing the switch 30, the toilet seat 14 will be automatically lowered after the flush action of the toilet 10. If the toilet seat 14 is up, the switch 106 is opened and the switch 116 is closed. Consequently, if the float switch 118 is closed once the float 40 closes the switch 42, the C-relay coil 112 and the D-relay coil 114 will be energized, thus again switching the polarity of the motor 92 to rotate the shaft 52 in a counter clockwise direction in order to lower the toilet seat 14. Furthermore, if the user fails to flush the toilet 10, and further leaves the toilet seat 14 in a raised position, the timing device 122 will automatically close a contact to apply current to the C-relay coil 112 and the D-relay coil 114 a predetermined time interval after the toilet seat 14 has been raised. The timing device 120 is repeatedly cycling through a set interval, and each time it reaches the end of the interval it will momentarily close a set of contacts to enable power to get to the C-relay coil 112 and the D-relay coil 114. Therefore, assuming the switch 116 is closed indicating that the seat 14 is raised, the seat 14 will be automatically lowered.

Figure 5:
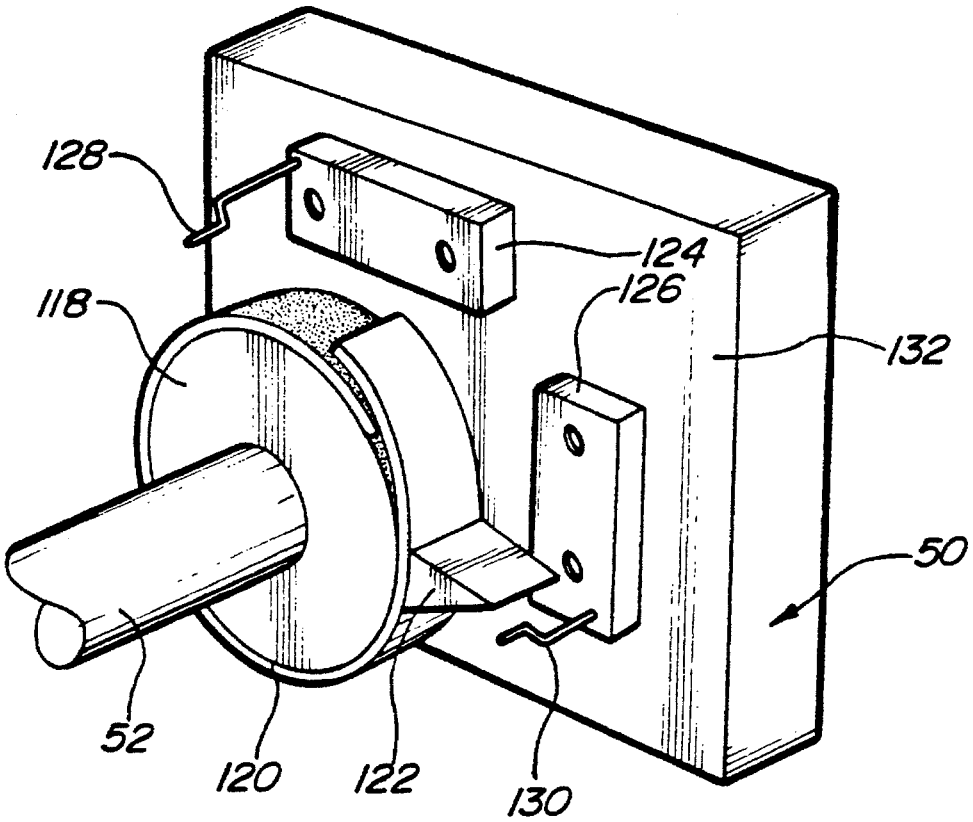
FIG. 5 is a perspective view of a switching mechanism of the automatic toilet seat device according to one embodiment of the present invention.

The method in which the automatic toilet seat device 24 knows if the toilet seat 14 is in a raised or lowered position can be accomplished by a variety of different methods. Turning to FIG. 5, a second embodiment of performing this task is shown. In this figure, the gear box 50 of the motor 28 is shown in a perspective view from an angle substantially opposite to that of FIG. 3, where the motor shaft 52 extends inwardly. The shaft 52 includes a barrel portion 118 in which a removable member 120 is shown rigidly attached to an outer perimeter of the barrel portion 118. The removable member 120 includes a protrusion member 122 extending radially out from the barrel portion 118. The removable member 120 is removable from the shaft 52 such that the protrusion member 122 can be repositioned on the barrel portion 118 in a desirable location, as will be discussed below. In a preferred embodiment, the removable member 120 is a strip of plastic material including a velcro attachment such that the removable member 120 can be easily wrapped around the barrel portion 118 and held there in a desirable position by the velcro attachment.

Connected to one surface 132 of the gear box 50 is a seat up switch 124 and a seat down switch 126. The method of connection can be by any suitable means, and as shown here is by screws. Each of the switches 124 and 126 are shown as elongated rectangular switches connected to the gear box 50 substantially perpendicular to each other. The switches 124 and 126 are electrically connected to the control circuit 26 by electrical wires (not shown). The seat up switch 124 and the seat down switch 126 each include a switch extension member 128 and 130, respectively. The switch extension members 128 and 130 extend from their respective switches 124 and 126 in a direction in which the shaft 52 extends such that the protrusion member 122 will contact the extension members 128 and 130 if the shaft 52 rotates far enough in the respective direction. Additionally, a magnetic attachment between one of either of the extension members 128 and 130 and the protrusion member 122 can be utilized for a more secured engagement. Consequently, when either of the extension members 128 and 130 is tripped, the control circuit 26 will know in what position the toilet seat 14 is in and can appropriately disengage the motor 28. Therefore, by visualizing the switch 124 as switch 106 and the switch 126 as switch 116 above, it becomes apparent how the switches 124 and 126 operate in the circuit 70.

Now turning to FIG. 6, a clutching mechanism 136 operable to be used in conjunction with the motor shaft 52 will be discussed. By including the clutching mechanism 136 in association with the shaft 52 of the electrical motor 28 discussed above, it is possible to lower or raise the toilet seat 14 by a manual operation when the shaft 52 is rigidly connected to the connecting section 54 and the motor 28. The clutching mechanism 136 is comprised of a cylindrical section 138 which houses the actual clutch device. The cylindrical section 138 is positioned around the shaft 52 such that if an excessive force attempts to rotate the shaft 52, as would happen from a manual intervention, the clutching mechanism will disengage allowing section 140 of the shaft 52 to rotate. A variety of different clutching mechanisms are known in the art, many of which would be applicable here, and as such need not be detailed. Also shown is a disengaging mechanism 142 which allows the toilet seat 14 to be disengaged from the device 24 if desired. The disengaging mechanism 142 can be any appropriate device which allows the shaft 52 to be separated from the connection section 54.

Figure 7:
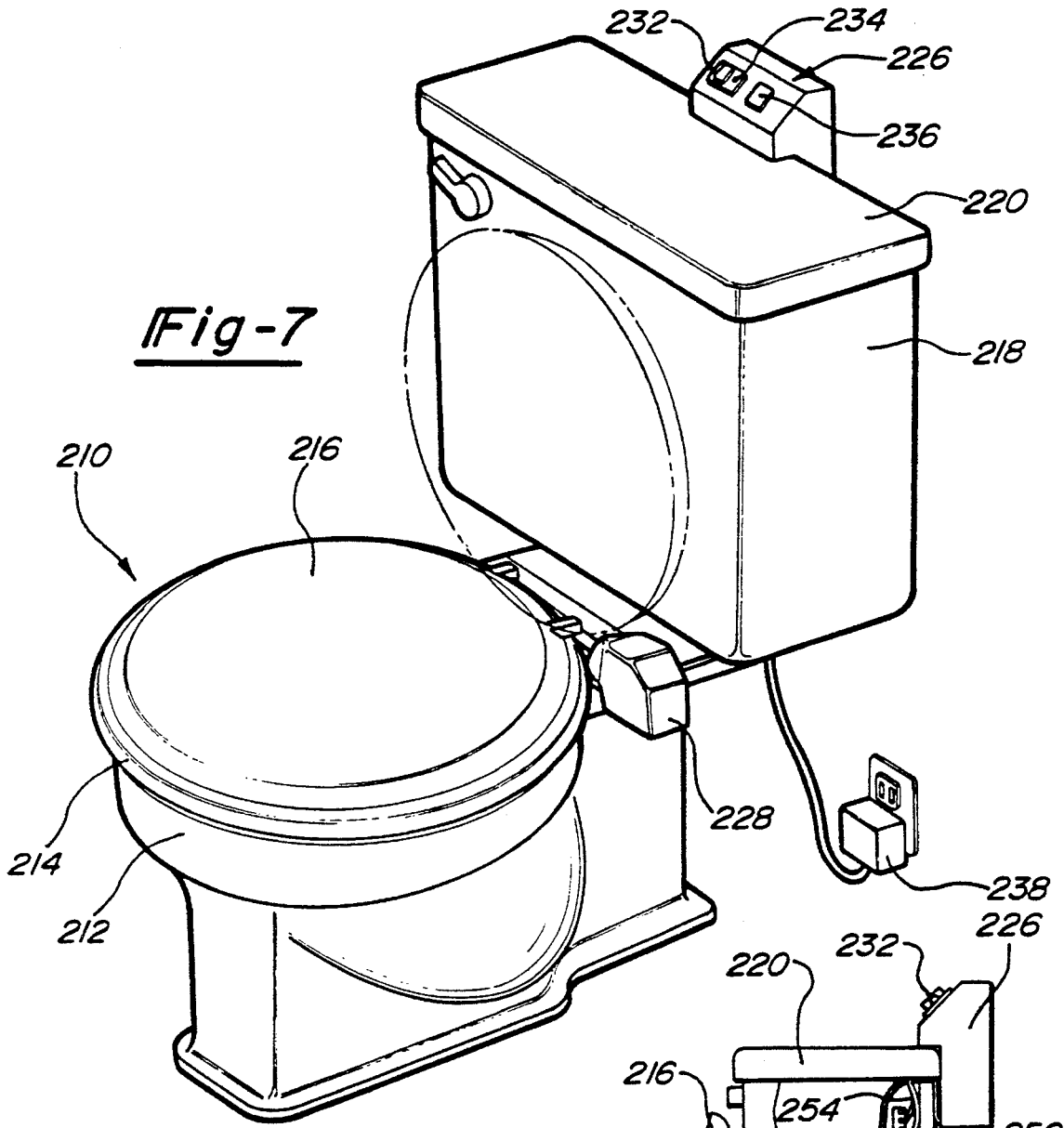
FIG. 7 is a perspective view of a toilet incorporating an automatic toilet seat device according to another embodiment of the present invention.
Figure 8:
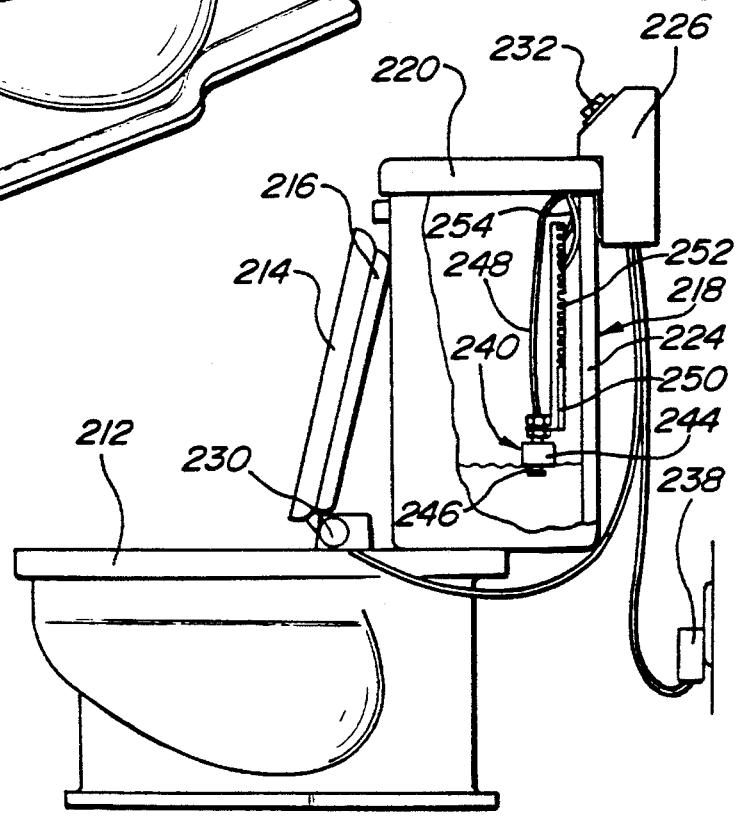
FIG. 8 is a side view of the toilet incorporating the toilet seat device of FIG. 7.

Turning to FIGS. 7 and 8, an alternate automatic toilet seat device associated with a toilet 210 according to another preferred embodiment is shown. The toilet 210 includes the traditional toilet components of a toilet bowl 212, a toilet seat 214, a toilet bowl lid 216 and a toilet tank 218 having a toilet tank lid 220. The toilet seat 214 and the toilet bowl lid 216 are shown in a lowered position, and are further shown in a raised position in phantom. The operation and structural aspects of the toilet 210 can be of any manner known, and thus, these aspects need not be elaborated on here.

The toilet seat device includes a control unit 226, shown here as a housing for enclosing electrical circuitry, and further shown being attached to a back wall 224 of the toilet tank 218 in a manner as will be discussed below. The toilet seat device further includes a motor housing 228 for enclosing a motor 230 (FIG. 8). The motor 230 is electrically connected to the control unit 226 by electrical wires, as shown. The control unit 226 includes an activation switch 232 and a display lamp 234 such as a light emitting diode. Further, the control unit 226 could include a jack for accommodating a foot switch in the manner as discussed above. Additionally, a night lamp 236 and associated photocell (not shown) can be included with the control unit 226. It will be understood that the control unit 226 can be of varying sizes and shapes to be in conformity with the electrical control circuitry, and can further be attached to any desirable location on the toilet 210 or a structure adjacent to the toilet 210. In one embodiment, the control unit 226 is an electrical box secured in a wall much in the same manner as a standard AC outlet box or switch box. The control circuit 226 preferably is operable to convert 120 volts AC from a standard outlet, but may include a self contained DC power source. As shown in FIG. 1, the control circuit 226 receives power from a standard AC outlet via a step-down transformer 238.

As will be discussed with specific detail below, the electric motor 230 is operable to rotate in both directions to either raise or lower the toilet seat 214 depending on the polarity of an electrical control signal applied to the motor 230 from the control unit 226. The electric motor 230 can be any suitable motor, preferably being as small as possible to accomplish the desired task. One specific applicable motor is a Dayton 1/200 hp, model YZ835 having a 580:1 gear ratio. The switch 232 will provide an electrical signal to the control unit 226 in order to instruct the electric motor 228 to either raise or lower the toilet seat 214 depending on its present position. If the toilet seat 214 is in a lowered position, a push of the switch 232 will raise the seat 214, but if the seat 214 is in a raised position, a push of the switch 232 will lower the seat 214.

The toilet seat device is further operable to lower the toilet seat 214 after the toilet 210 has been flushed. In FIG. 8, the toilet tank 218 is shown partially cut away to expose a float switch 240. The traditional toilet components within the tank 218 are not shown. The float switch 240 includes a floatable portion 244 which is floatable on the surface of the water within the tank 218 along a shaft 246 only when the water level is below a bottom surface of an L-shaped bracket 250. In other words, once the floatable portion 244 contacts the bracket 250 and is submerged underwater, it is pinned in this location due to its buoyancy. After the toilet 210 has been flushed, the floatable portion 244 will drop to its lowest level in association with the shaft 246. Once the floatable portion 244 separates from the bracket 250 in association with the water level in the tank 218, a magnet (not shown) within the floatable portion 244 causes a reed switch (not shown) within the shaft 246 to be activated. The reed switch will then send a signal to the control circuit 226 via electrical wires 248 to indicate that the toilet 210 has been flushed. Alternately, the signal can be sent when the floatable portion 244 recontacts the bracket 250 after the water level rises. The toilet seat 214 and the toilet lid 216 are shown in a raised position in FIG. 3 even though the water level is indicating a flush has occurred because there is a delay between the time the switch 240 sends the signal and the time the seat 214 is lowered. A float switch which operates in this fashion is commercially available from Signal Systems International of Lavalette, N.J., Model No. FS2A.

The position of the float switch 240 is adjustable within the tank 218. Specifically, the float switch 240 is adjustable by the L-shaped bracket 250. The bracket 250 includes a series of holes 252 along a surface of the bracket 250 adjacent the back wall 224 of the tank 218. A bracket clip 254 hooks over the back wall 224 of the tank 218 and has legs which are inserted into the holes 252 such that if the legs are inserted into different holes, the level of the float switch 240 within the tank 218 can be adjusted. The specifics of the clip 254 and bracket 250 will be discussed in greater detail below with reference to FIGS. 12A and 12B.

Figure 9:
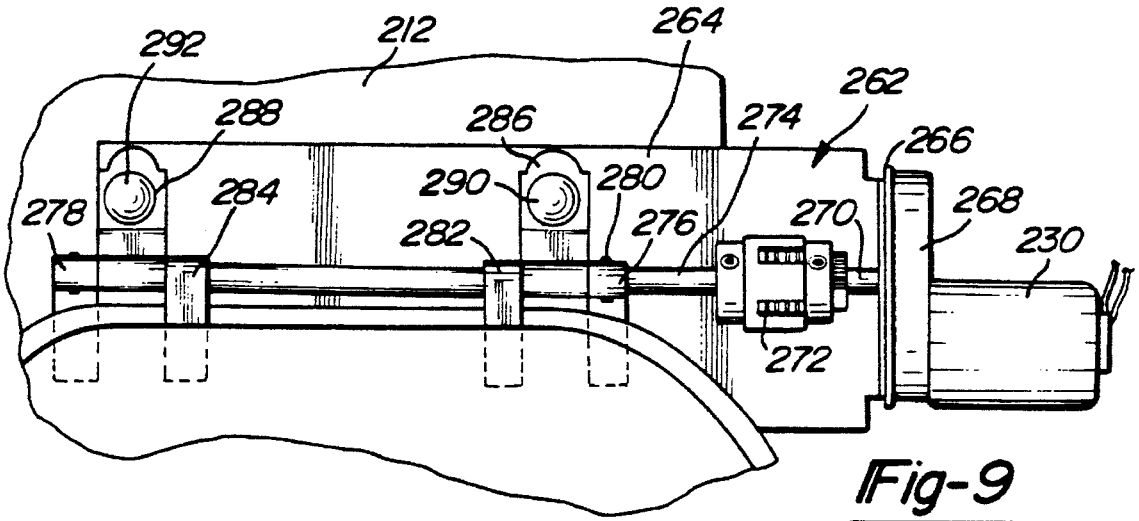
FIG. 9 is a top view of a motor, a clutching mechanism and a drive shaft as part of the automatic toiled seat device of FIG. 7.

Now turning to FIG. 9, a top view of a portion of the toilet seat device is shown. In a preferred embodiment, the toilet seat 214, the toilet lid 216 and the motor 230 and housing 228 are part of a common unit secured to a single support member 262. The support member 262 includes a horizontal plate portion 264 and a vertical plate portion 266. The electrical motor 230 includes a gear box 268 secured to the vertical plate portion 266 by a set of bolts or the like. A motor shaft 270 extends from the gear box 268 and is engagable with a clutch mechanism 272.

A drive shaft 274 extends from the clutch mechanism 272 through tab portions 276 and 278 connected to the toilet seat 214. The tab portions 276 and 278 are rigidly secured to the shaft 274 by means of set screws 280 such that when the shaft 274 rotates, the toilet seat 214 will be pivoted. Even though the toilet seat 214 is rigidly secured to the shaft 274, the toilet seat 214 can be manually articulated relative to the toilet bowl 212 by the clutching mechanism 272. In a preferred embodiment, the clutch mechanism 272 is a slip-ease Polyclutch® commercially available from Custom Products Corporation of North Haven, Conn.

The shaft 274 also extends through tab portions 282 and 284 associated with the toilet lid 216. In this case, however, the tab portions 282 and 284 are loosely secured to the shaft 274 so that the toilet lid 216 can articulate relative to the shaft 274. In other words, the toilet lid 216 is operable to be raised or lowered without rotating the shaft 274. As is obvious, when the toilet seat 214 is raised by the motor 230, the toilet lid 216 will also be raised. Tab portions 286 and 288 are rigidly secured to the shaft 274 and are bolted by means of bolts 290 and 292 to the toilet bowl 212 through the support member 262 such that the toilet lid 216, the toilet seat 214, the motor 230 and the clutching mechanism 272 are all secured to the toilet bowl 212.

Figure 10A:
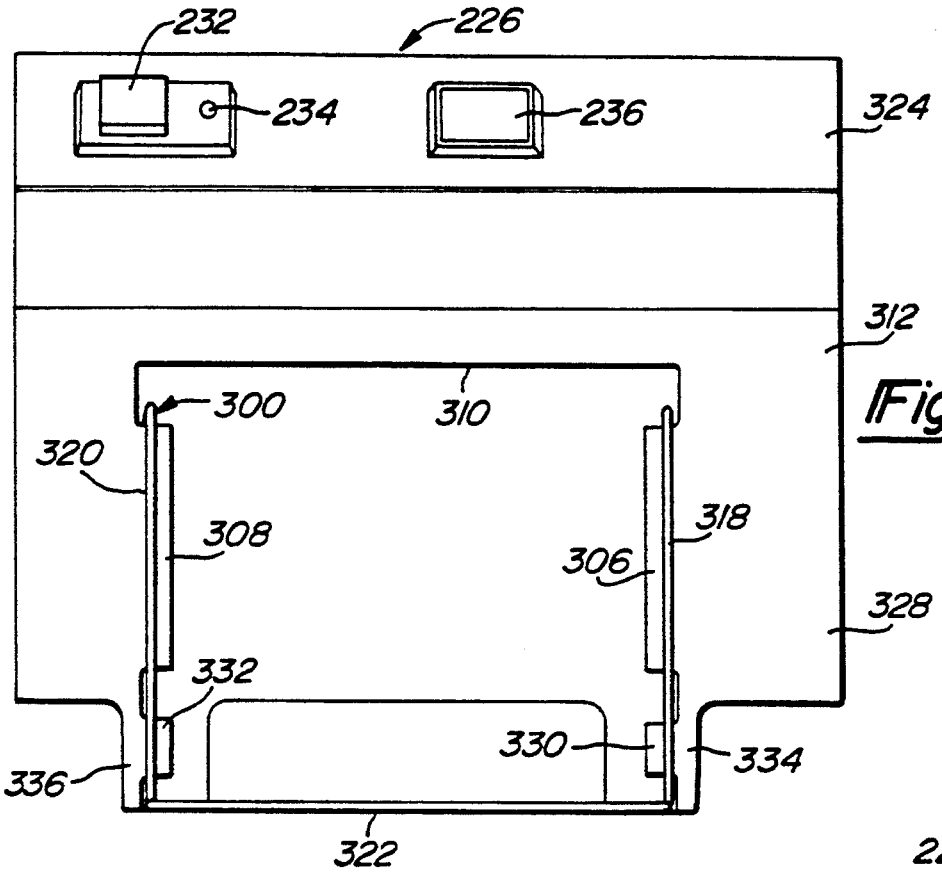
FIGS. 10A and 10B are front and side views of a control device associated with the automatic toilet seat device of FIG. 7.
Figure 11A:
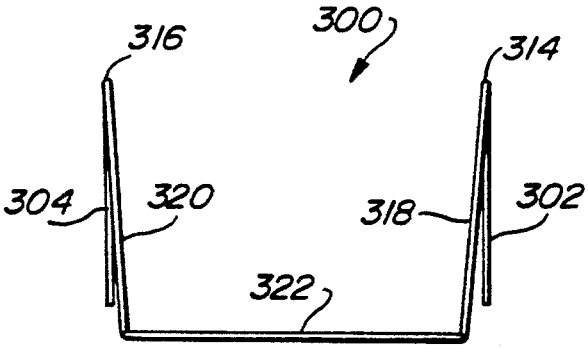
FIGS. 11A and 11B are a front and side view of a bracket for clipping the control device of FIG. 10 to a toilet tank.
Figure 11B:
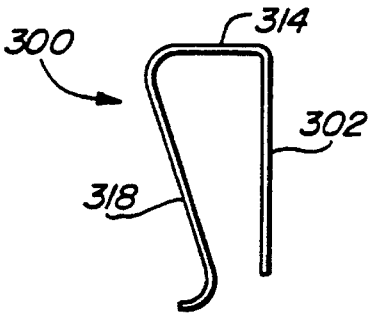
Figure 10B:
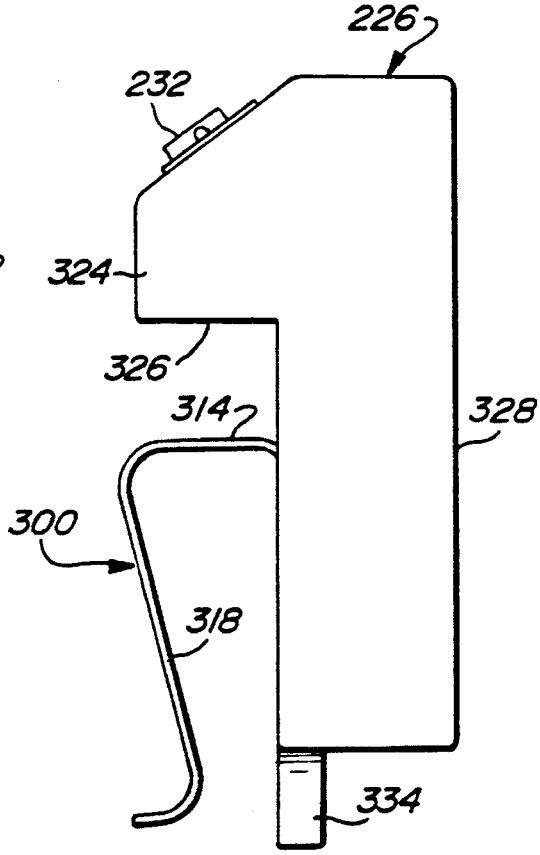
Figure 13:
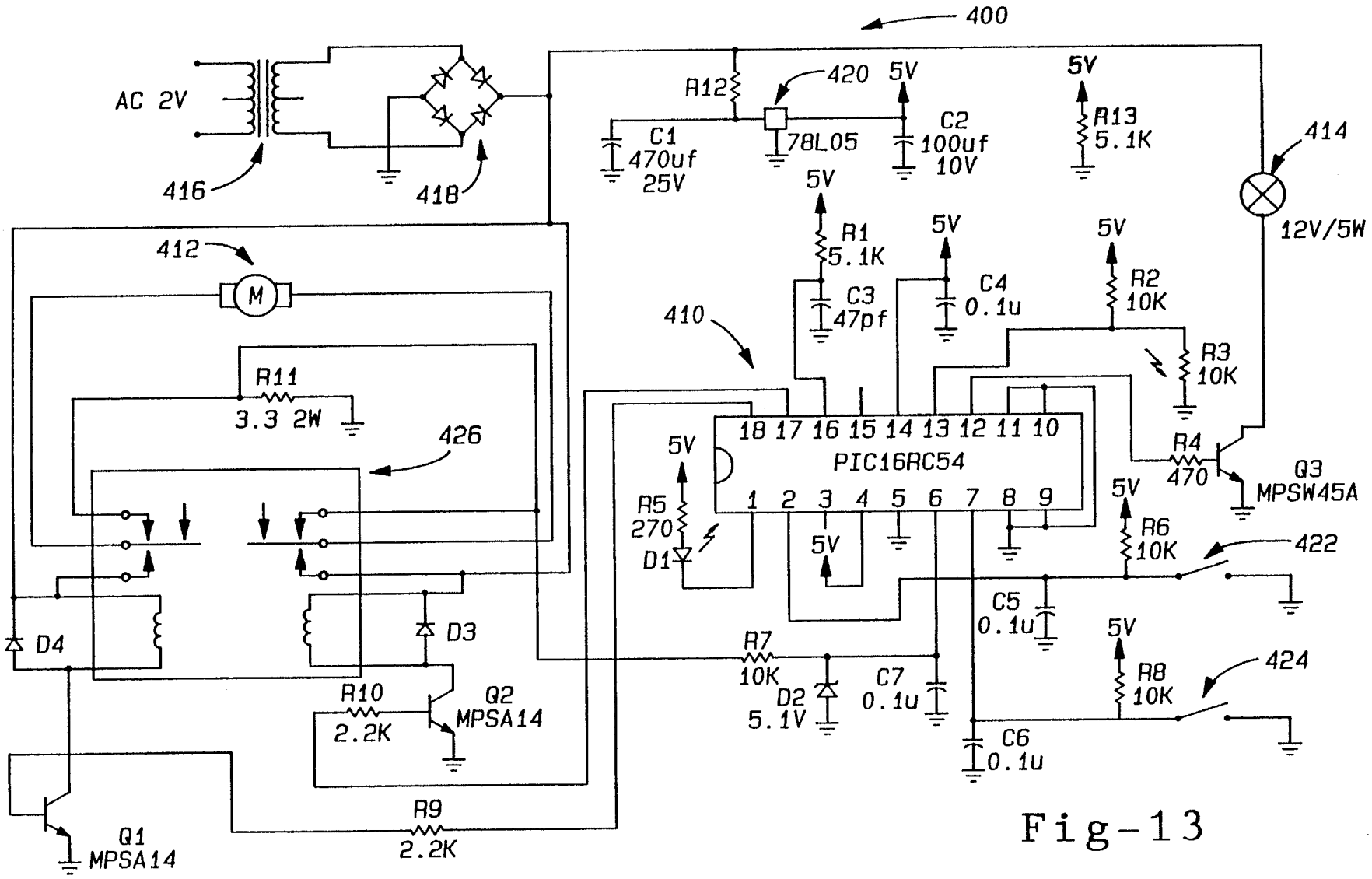
FIG. 13 is a schematic diagram of the control circuit of the automatic toilet seat device according to an embodiment of the present invention.

Now turning to FIGS. 10A and 10B, the control unit 226 is shown in a front view and a side view, respectively. In order for the control unit 226 to be connected to the back wall 224 of the toilet tank 218, a clipping bracket 300 is provided. As shown more clearly in FIGS. 11A and 11B, the clipping bracket 300 includes a first leg portion 302 and a second leg portion 304. The first and second leg portions 302 and 304 are positioned behind tab portions 306 and 308, respectfully. The tab portions 306 and 308 extend from the sides of an indented portion 310 in a front face 312 of the control device 226. A first extended portion 314 and a second extended portion 316 extend from the leg portions 302 and 304, respectively, and are adaptable to rest on a top surface of the tab portions 306 and 308. When the control unit 226 is clipped to the toilet tank 218, the extended portions 314 and 316 rest on a top surface of the back wall 224. Additionally, the extended portions 314 and 316 will be forced against a top surface of the indented portion 310. A third leg portion 318 and a forth leg portion 320 extend from the extended portions 314 and 316, respectively, and are connected together by a front extended portion 322. The front extended portion 322 and the leg portions 318 and 320 are positioned within the tank 218 when the control unit 226 is clipped to the toilet tank 218.

The control unit 226 includes an extended top portion 324 which is adaptable to be positioned on top of the toilet tank lid 220 (see FIG. 1). In this manner the width of the toilet tank lid 220 is positioned between a bottom surface 326 of the extended top portion 324 and the extended portions 314 and 316 of the bracket 300. If, however, the toilet tank lid 220 does not fit within this space, the bracket 300 can be removed from the opening 310 by flexing the leg portions 302 and 304 towards each other, and be positioned such that the extended portions 314 and 316 of the bracket 300 rest on a top surface of tab portions 330 and 332. The control unit 226 includes extension legs 334 and 336 to accommodate the tab portions 330 and 332.

Figure 12A:
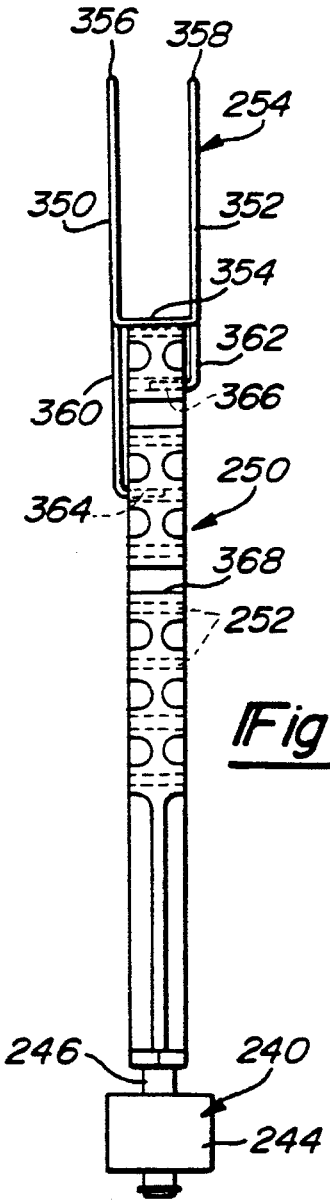
FIGS. 12A and 12B are front and side views of a float switch and associated bracket according to an embodiment of the present invention.
Figure 12B:
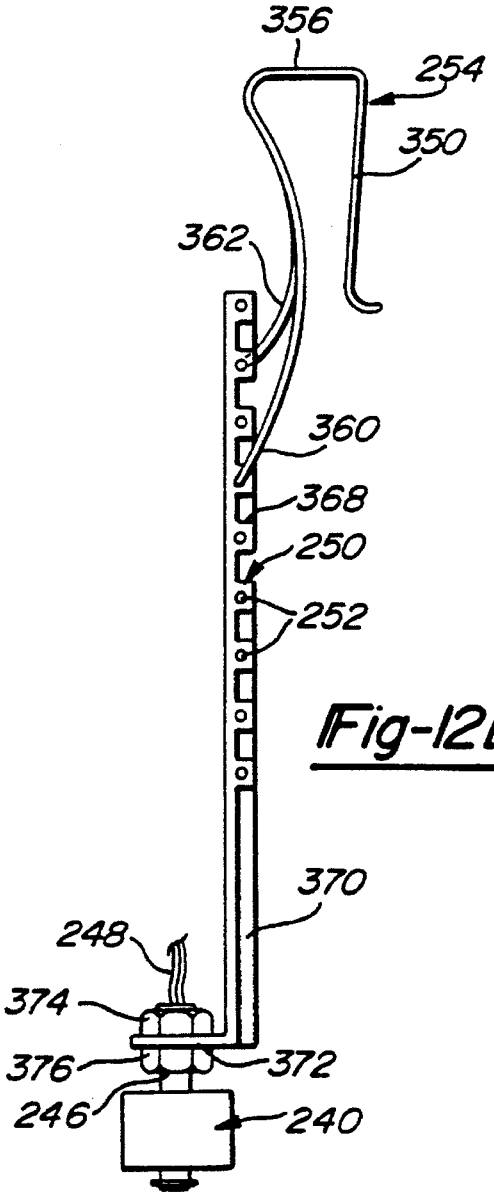

Turning to FIGS. 12A and 12B, a front and side view of the bracket 250 and the bracket clip 254 are shown. The bracket clip 254 includes a first leg portion 350 and a second leg portion 352 which are connected together by an extendable portion 354. A first top portion 356 and a second top portion 358 are connected to the leg portions 352 and 350, respectively, and are adaptable to rest on a top surface of the tank wall 224. Extending from the top portion 356 and the top portion 358 is a third leg portion 360 and a forth leg portion 362, respectively. The leg portions 360 and 362 each include a hook portion 364 and 366, respectively, at an end opposite from the top portion 356 and 358 which are slidably insertable in the holes 252, as shown. By flexing the leg portions 360 and 362, the hook portions 364 and 366 can be removed from one set of holes 252 and selectively engaged in a second set of holes 252 such that the float switch 240 can be adjusted with respect to the water level in the tank 218.

FIG. 12B shows that the bracket 250 includes an extended vertical portion 370 and a horizontal portion 372 on which is secured the float switch 240. A set of bolts 374 and 376 are adaptable to secure the shaft 246 for the portion 372 such that float switch 240 is rigidly held in place. The vertical portion 370 includes a number of indented areas 368 such that the vertical portion 370 can be broken at selected areas in order to fit within different sized tanks.

Figure 6:
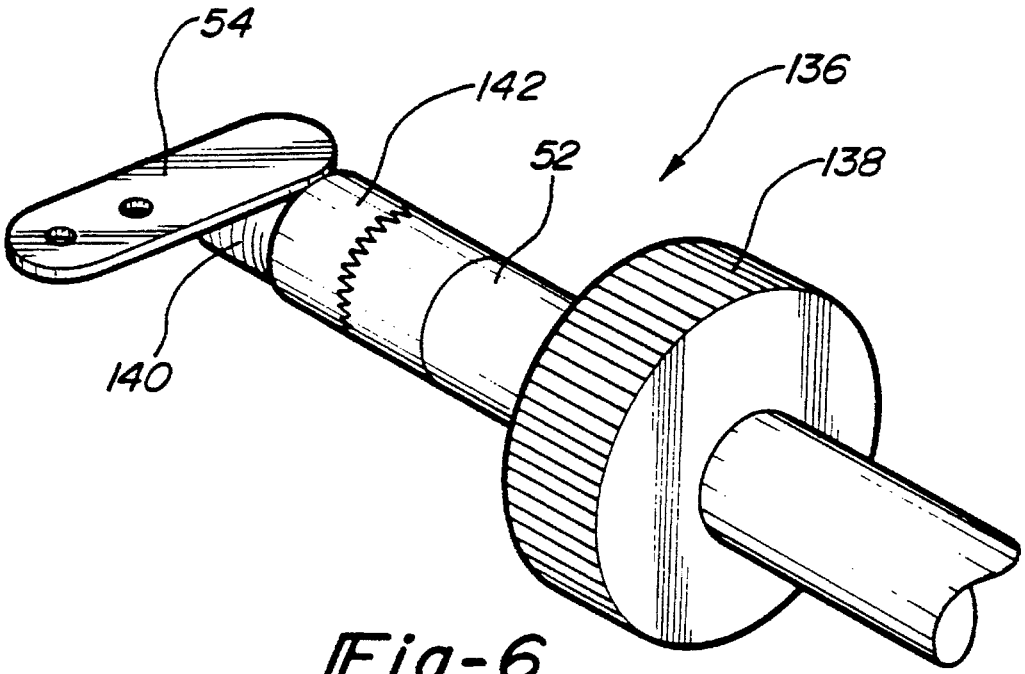
FIG. 6 is a perspective view of a clutch mechanism of the automatic toilet seat device according to one embodiment of the present invention.

Turning to FIG. 6, a schematic diagram of a control circuit 400 of the automatic toilet seat device is shown according to a preferred embodiment. The control circuit 400 would be housed in the control unit 226. A microcontroller 410 acts as a central processor for the control circuit 400 such that a motor 412 and a lamp 414 are activated in a desirable fashion. The microcontroller 410 is a commercially available device and, in a preferred embodiment, is an 18 DIP processor no. PIC16RC54, available from Microchip Technology. The motor 412 is a schematic representation of the motor 230, above. Likewise, the lamp 414 is a schematic representation of the night lamp 236.

In order to provide power to the control circuit 400, a 120 V AC line is applied to a 120/12 V transformer 416. The secondary winding of the transformer 416 is connected to a bridge rectifier 418 in order to convert the AC power signal to a DC power signal to be applied to the components of the circuit 400. A 12 V DC output signal is applied to the motor 412 and the lamp 414 from the bridge rectifier 418. However, a voltage regulator 420 is provided in order to drop the 12 V power output from the bridge rectifier 418 to 5 V DC power signal applicable for the microcontroller 410. The operation of transformers, bridge rectifiers and voltage regulators are well-known in the art, and thus need not be discussed here. The transformer 416 and the bridge rectifier 418 can be eliminated and a 12 V DC battery substituted in their place.

A switch 422 represents the activating switch 232 and a switch 424 represents the float switch 240. When the switch 422 is activated, pin 2 of the microcontroller 410 is pulled low which causes pins 17 and 18 of the microcontroller 410 to activate the motor 412 through a relay 426. The relay can be any appropriate relay which performs the desired function. One specific example is a Potter and Brumfield V2R-1001. The switch 424 operates in the same fashion to enable the seat 214 to automatically be lowered when the toilet 210 is flushed after a predetermined delay as programmed in the microcontroller 410.

A high signal on pin 18 and a ground signal on pin 17 will cause the motor 412 to rotate in the direction which will raise the seat 214. Likewise, a ground signal on pin 18 and a high signal on pin 17 will cause the motor 412 to rotate in a direction which will lower the seat 214. In its initial start-up or reset mode, the microcontroller 410 will apply a signal to the pins 17 and 18 such that the seat 214 will be raised. After this initial motor direction, the microcontroller 410 will store in its memory the last polarities applied to the pins 17 and 18 such that the next time the polarities will be reversed, thus causing the motor 412 to rotate in the opposite direction. As will be discussed in greater detail below, if the seat 214 is already up at reset, or is manually lifted or lowered, thus causing the last stored motion of the motor 412 in the microcontroller 410 to be inaccurate, an over-current detection feature will cause the microcontroller 410 to get back on track.

Depending on whether the output of pin 17 or 18 is high, the appropriate transistor Q1 or Q2 will amplify the high signal before it is applied to the relay 426. The operation of the relay 426 is such that depending on which input line the high signal is placed, the appropriate polarity will be applied to the motor 412 in order to cause it to rotate in the desired direction. By studying the input and output lines of the relay 426, as well as the electrical connection of the inductors associated with the relay 426, one can satisfy himself that this will be the case. Diodes D3 and D4 protect the amplifying transistors Q2 and Q1, respectively, so as to prevent the inductors associated with the relay 426 from being discharged too rapidly.

As the motor 412 is either raising or lowering the seat 214, it will eventually reach the toilet bowl 212 or the toilet tank 218 depending on which direction it is rotating. Once this happens, the motor 412 will be prevented from rotating such that excess current is generated in the motion 412 which is detected by the microcontroller 410, and thus, cause it to turn the motor 412 off. Because of this feature, if the seat is either raised or lowered manually such that the last stored polarity of pins 17 and 18 will be inaccurate, the microcontroller 410 will sense over-current immediately, and then cause the motor 412 to reverse its direction. Additionally, a user may stop the motion of the toilet seat 214 at any time by pressing the switch 422 when the seat 214 is moving. Pressing the switch 422 again will reverse the direction of the motor 412 such that if the motor 412 is activated to cause the seat 214 to be either raised or lowered, activation of the switch 422 again will cause the seat 214 to stop in mid-travel, and activation of the switch 422 again will cause it to reverse its direction. The over-current detection also provides a safety feature in that if a child's hand is caught between the toilet seat 214 and the toilet bowl 212, the motor 412 will turn off.

The motor over-current sensing is sensed by a resistor R11 in that if the motor current increases, the resistance through resistor R11 will increase, and a high signal will be generated at pin 6 of the microcontroller 410. A Zener diode D2 is incorporated such that any voltage above 5 volts will be bled to ground in order to protect the microcontroller 410.

A light emitting diode D1, as representative of the lamp 236 above, is provided such that if the diode D1 is illuminated, it indicates that the microcontroller 410 is receiving power. Additionally, if the diode D1 is flashing when the toilet device is activated, this is an indication that the microprocessor 410 is functioning properly.

The lamp 314 is illuminated if light as sensed by a photoresistor R3 is decreased below a predetermined level. When this happens, the resistance in R3 increases which causes pin 13 of the microcontroller 410 to go high such that pin 12 goes high and turns on the switch transistor Q3 such that the lamp 414 can be illuminated.

The microprocessor logic includes a timing window safety feature such that the motor 412 can only run for a predetermined maximum time before the microprocessor 410 shuts the motor 412 off. Further, the microprocessor logic includes short-circuit detection logic which shuts off the motor 412 if the motor poles are short-circuited. The remaining circuit elements as connected are common in the art, and therefore, their function need not be discussed here.

Figure 14:
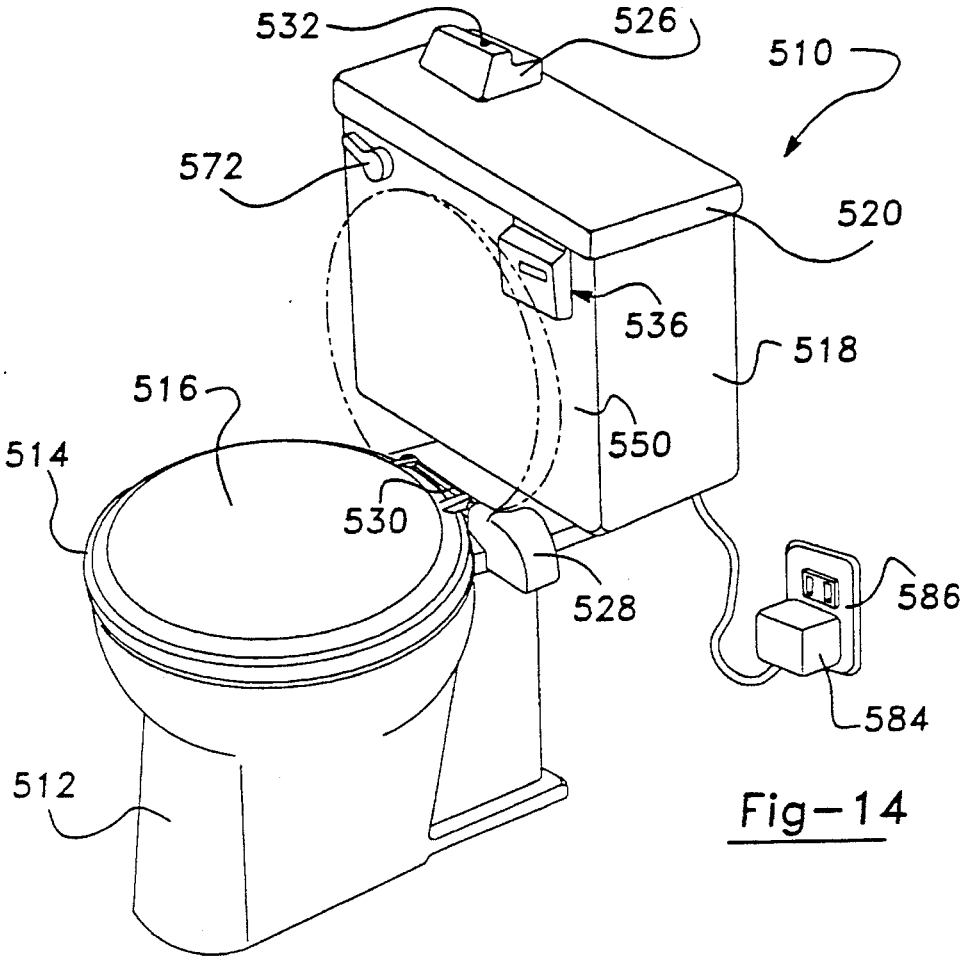
FIG. 14 shows a right side perspective view of a tank-type toilet incorporating an automatic flushing system and an automatic toilet seat device according to an embodiment of the present invention.

Now referring to FIG. 14, a toilet fixture 510 is shown of the tank type including the traditional toilet components of a toilet bowl 512, a toilet seat 514, a toilet bowl cover 516 and a toilet tank 518 having a toilet tank lid 520. The toilet seat 514 and the toilet bowl cover 516 are connected to the toilet bowl 512 in a known manner such that the seat 514 and the cover 516 can articulate relative to the toilet bowl 512 between a raised and lowered position, as is well understood. The toilet seat 514 and the toilet bowl cover 516 are shown in the lower position, and are further shown in the raised position in phantom. The operation and structural aspects of the toilet fixture 510 can be of any manner known, and thus, these aspects need not be elaborated on here.

The toilet fixture 510 includes an automatic toilet seat device, according to an embodiment of the present invention, including a toilet seat control device 526 secured to a top surface of the toilet tank lid 520 by any appropriate securing device (not shown). The control device 526 is shown here as an electrical box for housing an electrical circuit. The housing of the electrical box can be a molded plastic housing having a removable cover. The toilet seat device also includes an electric motor (see FIG. 25) positioned within a motor housing 528. The motor is attached to a shaft 530 connected to the toilet seat 514 and the toilet bowl cover 516. The electric motor within the housing 528 is operable to either raise or lower the toilet seat 514 depending on an electrical control signal from the control device 526. In one embodiment, the control device 526 emits an infrared signal from a filter window 532 associated with the control device 526 to activate the control device 526 and cause the motor to raise the toilet seat 514.

The automatic toilet seat device operates in a similar manner to the automatic toilet seat device 24 discussed above. However, the toilet seat device of this embodiment includes a number of advantages and improvements over the automatic toilet seat device 24. In one embodiment, the toilet seat control device 526 will allow the seat 514 to move up or down by a touch of a button, as discussed above, or by the wave a user's hand over the window 532. An infrared sensor (see FIG. 31) detects body heat from the user's hand to activate the device 526. The user's hand will pass through the sensing area of the infrared sensor, and will signal the control device 526 to actuate the seat 514. A subsequent pass of the user's hand will cause the control device 526 to actuate the seat 514 in the opposite direction.

Figure 15:
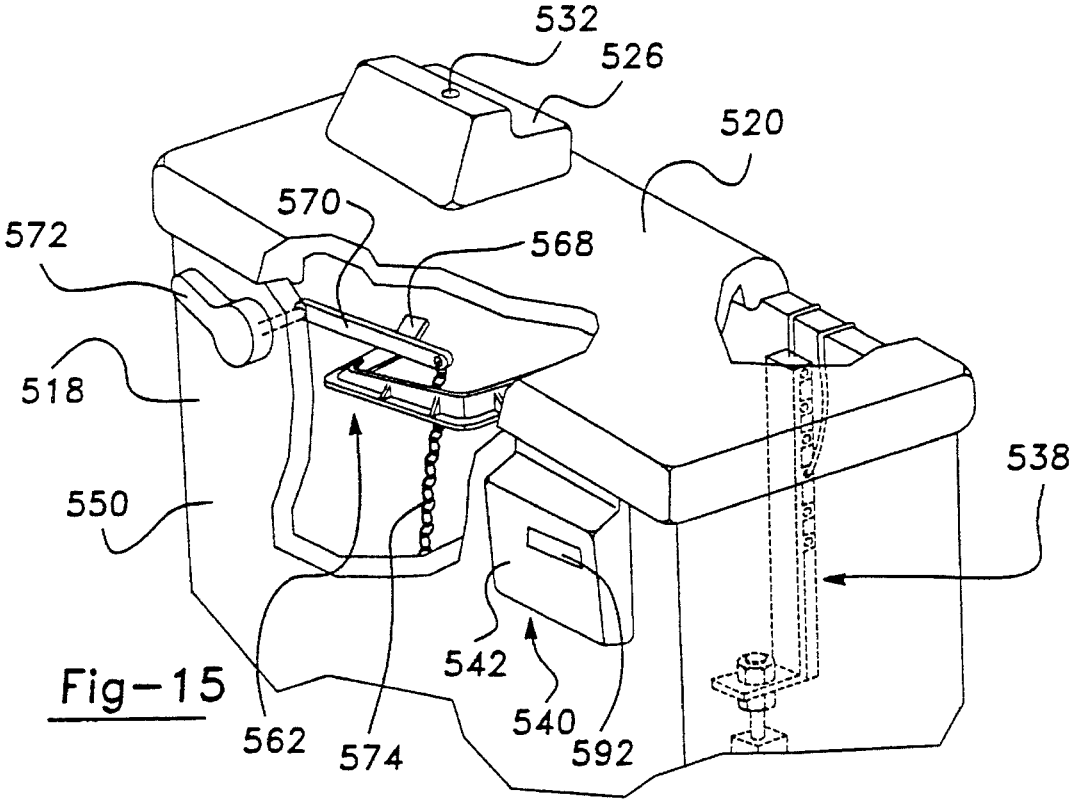
FIG. 15 shows a broken-away perspective view of the tank of the toilet of FIG. 14 showing a flush arm, lift arm and float switch of the invention.
Figure 16:
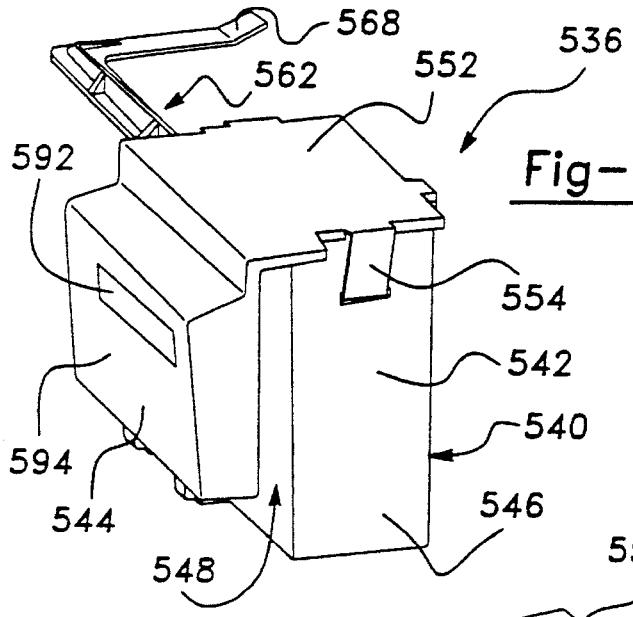
FIG. 16 shows a right side perspective view of the automatic flushing system of the invention.
Figure 17:
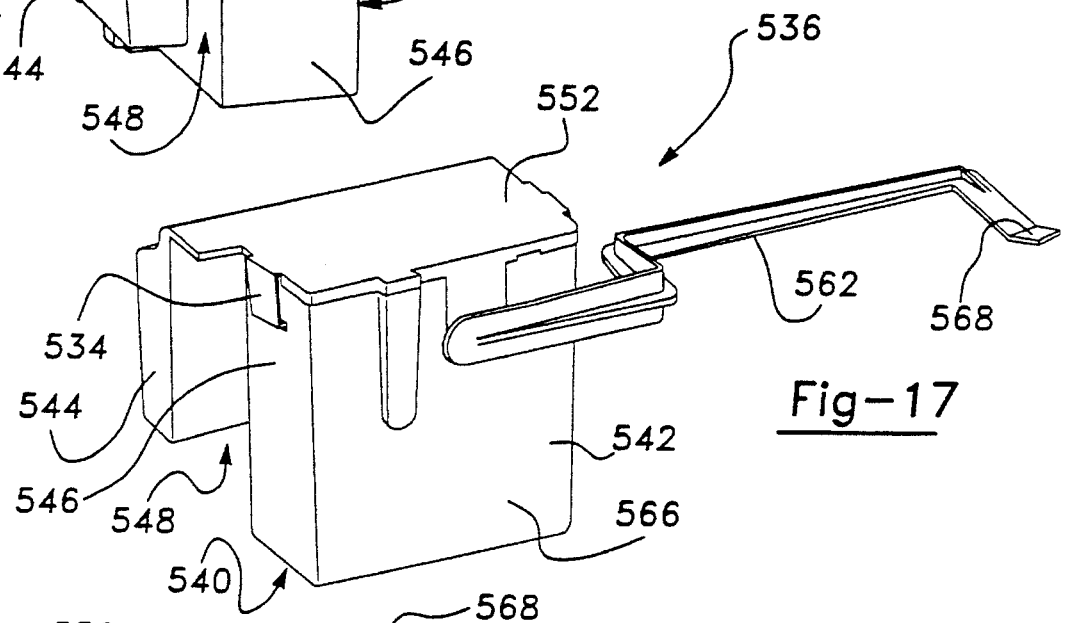
FIG. 17 shows a back side perspective view of the automatic flushing system of FIG. 16.
Figure 18:
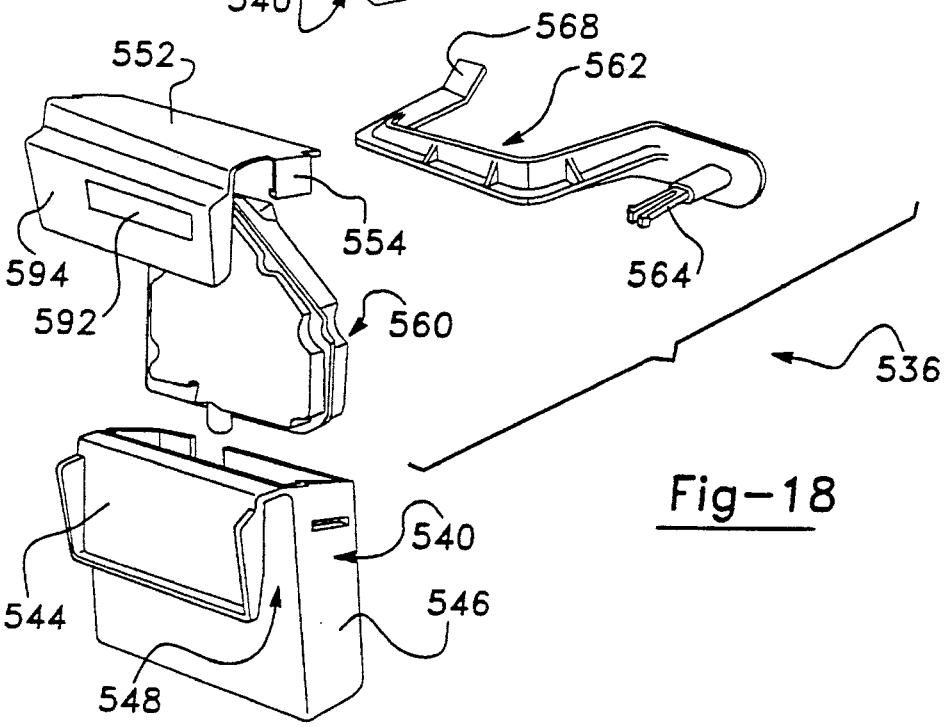
FIG. 18 shows a blown apart perspective view of the automatic flushing system of FIG. 16.

In accordance with the teachings of the present invention, the toilet fixture 510 includes an automatic flushing system 536 that automatically flushes the toilet fixture 510, and is operable in association with the automatic toilet seat device. The automatic flush system 536 will first be discussed with reference to FIGS. 15–19. FIG. 15 shows a broken-away perspective view of a portion of the toilet tank 518. A float switch 538 is shown hanging from a back wall of the tank 518, and is used in association with the automatic seat device, as will be discussed below. FIGS. 16 and 17 show different perspective view of a control unit 540 of the automatic flushing system 536. FIG. 18 shows a blown apart perspective view of the control unit 540 and some of its components.

The control unit 540 includes an outer housing 542. The outer housing 542 is separated into a control circuit housing 544 to be positioned on an outside of the tank 518, and a motor housing 546 to be positioned within the tank 518. A slot 548 is defined between the control circuit housing 544 and the motor housing 546 to accommodate a front wall 550 of the toilet tank 518 so as to secure the control unit 540 to the tank 518. In one embodiment, the control circuit housing 544 and the motor housing 546 are a single injection molded plastic piece. An injection molded cover 552 covers both the control circuit housing 544 and the motor housing 546. A pair of snap legs 554 integral with the cover 552 snap to the motor housing 546 to secure the cover 552 to the housing 542 in a water tight manner so as to prevent water within the tank 518 from entering the motor housing 546.

A sealed, water-tight flush motor 560 is positioned within the motor housing 546. In one embodiment, the motor 560 is a yellow E actuator from CEI. However, as will be appreciated by those skilled in the art, other types of electrical motors may be equally applicable to be used in the place of the motor 560. A lift handle 562 extends from the motor housing 546, as shown. In one embodiment, the lift handle 562 is a curvilinear injection molded plastic arm. The lift handle 562 includes an integral shaft 564 that engages the motor 560 through a back wall 566 of the motor housing 546 in a secure manner. Upon activation of the motor 560, the lift handle 562 pivots relative to the motor housing 546. A lift portion 568 of the lift handle 562 is formed at one end of the handle 562 opposite to the motor 560. The lift portion 568 is positioned beneath a flush arm 570 within the tank 518. Because the lift handle 562 is positioned below the flush arm 570, the flush arm 570 is free to flush the toilet fixture 510 when the automatic flushing system 536 is not operational. The flush arm 570 is connected to a flush handle 572 secured to an outer portion of the tank 518 adjacent the front surface 550. The flush arm 570 and the flush handle 572 are known and common features of many different styles of tank-type toilets.

Activation of the motor 560 rotates the shaft 564 and causes the lift handle 562 to pivot upwards such that the lift portion 568 applies upward pressure on the flush arm 570. The flush arm 570 will pivot upward at a pivot point where it connects to the flush handle 572 in the same manner as if a user applied downward pressure on the flush handle 572 to flush the toilet fixture 510 in the traditional manner. A chain 574 connected to an end of the flush arm 570 opposite to the flush handle 572 lifts a plunger valve (not shown) positioned in an opening (not shown) of the tank 518 to cause the toilet fixture 510 to flush in the traditional manner. As will be discussed in detail below, the travel of the lift handle 562 can be adjusted to different types of flush arms 570 such that the lift arm 560 only moves far enough to flush a particular toilet fixture 510. Once the lift handle 562 has raised the flush arm 568 high enough to flush the toilet fixture 510, the motor 560 then rotates the shaft 564 in the opposite direction to cause the lift handle 562 to pivot downward to a rest location for the next flush. Therefore, the plunger valve will return to the opening and the tank 518 will fill with flush water for the next flush as is well understood in the art.

Figure 19:
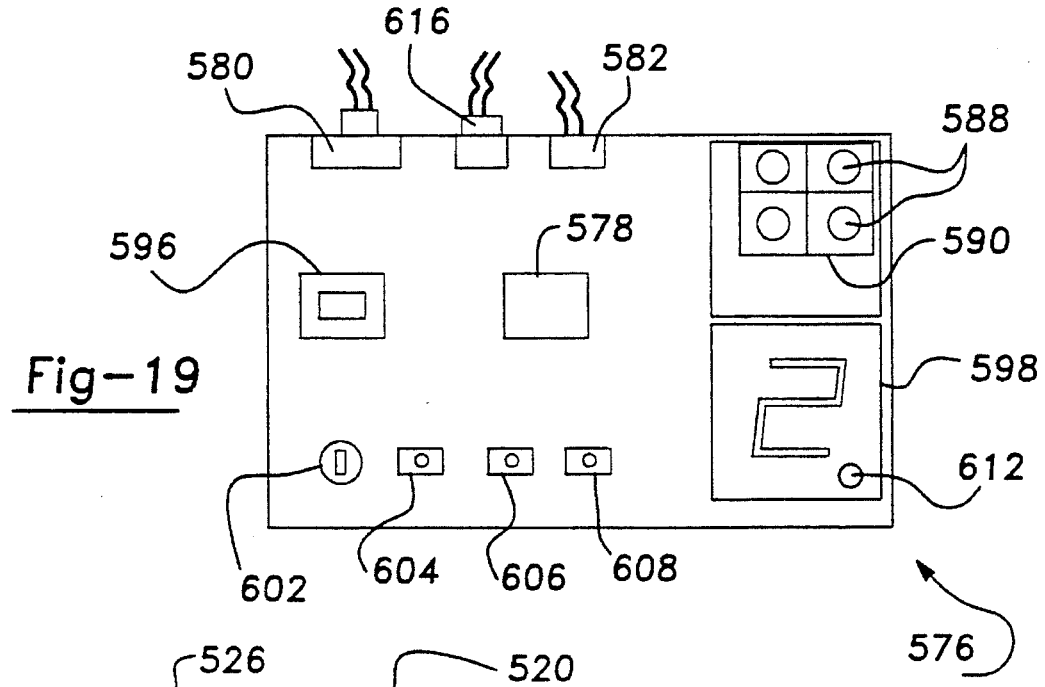
FIG. 19 shows a general overview of a circuit board of the automatic flushing system of the invention.

A printed circuit control board 576, as generally depicted in FIG. 19, is secured within the control housing 544. The control board 576 is microprocessor controlled by a microprocessor 578 to control the operation of the motor 560. In one embodiment, the microprocessor 578 is an 18-pin surface mount BU 2444 chip available from the Rohn Corp. However, as will be appreciated by those skilled in the art, other microprocessors can be used that would be within the scope of the invention. The control circuit board 576 includes an electrical connector 580 to electrically connect the board 576 to the motor 560, and an electrical connector 582 to provide electrical power to the board 576. In one embodiment, the electrical power is applied to the board 576 from the control device 526 from an AC transformer 584 electrically connected to an electrical outlet 586. Of course, other power sources, such as batteries, can apply power to the board 576.

A series of four infrared transmitters 588 are positioned within an appropriate configured light guide 590 to transmit infrared beams to a target location in front of the toilet 510 through a filter 592 positioned in a front panel 594 of the housing cover 552. The filter 592 allows passage of infrared radiation from the transmitters 588, and significantly filters other ambient light. Radiation reflected from the target location is transmitted back through the filter 592 and is collected by an infrared detector 596 that senses the intensity of the reflected beam. As will be appreciated by those skilled in the art, any suitable type of transmitter and detector, including a different number of infrared transmitters, can be used within the scope of the invention. The detector 596 sends a low voltage electrical signal indicative of the intensity of the received infrared signal from the target location to the microprocessor 578. The electrical signal from the detector 596 is analyzed by the microprocessor 578 to determine if the reflected beam is of the type that would indicate the presence of a user in the target location. If the microprocessor 578 determines that a user is in the target location, then the microprocessor 578 goes through the system operation. A power LED digital readout 598 provides an indication of system operation, as will be discussed in detail below. The user can visualize the digital readout 598 through the filter 592.

Figure 20:
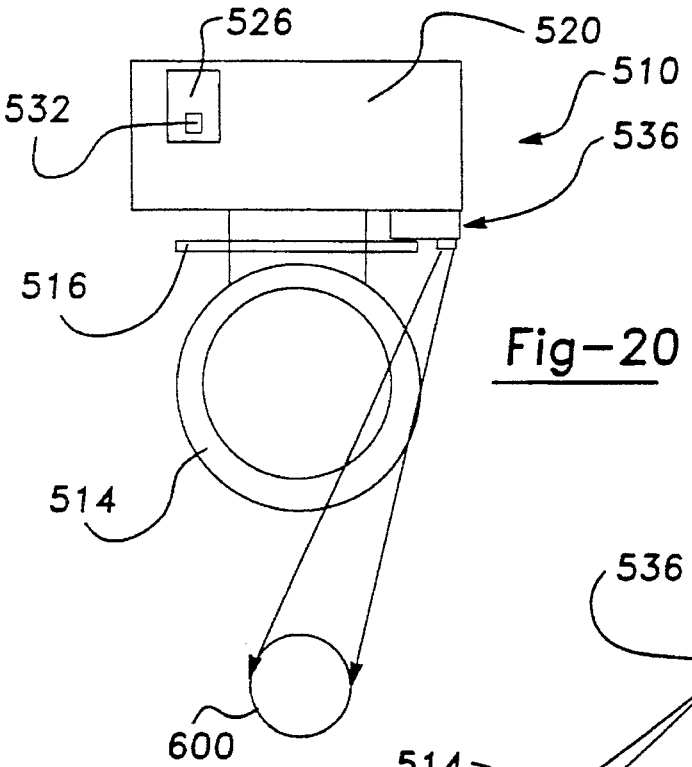
FIG. 20 shows a top view of a toilet depicting a target area of the automatic flushing system of the invention.
Figure 21:
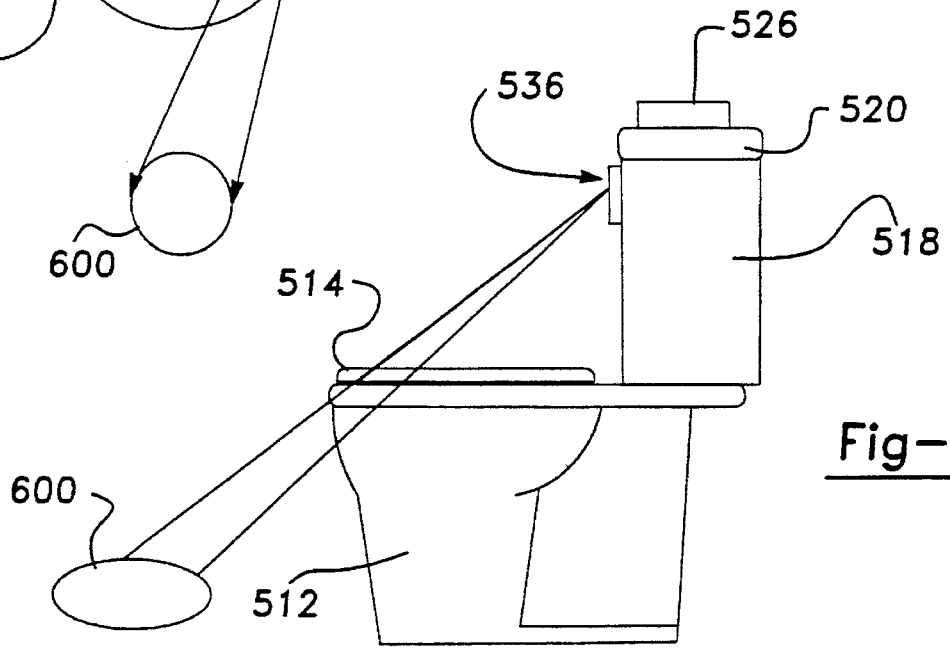
FIG. 21 shows a side view of the target area of FIG. 20.

The beam direction and intensity from the transmitters 588 are calibrated to project a certain intensity infrared beam to a desirable target area in front of the toilet fixture 510. FIG. 20 shows a top view and FIG. 21 shows a side view of the toilet fixture 510 in relation to a detection area 600 directly in front of the toilet bowl 514. In one embodiment, the transmitters 588 are directed by the light guide 590 to provide a target area approximately four feet in front of the front surface 550 of the toilet tank 518. To accomplish this from the position of the control unit 540 as shown in FIG. 14, the transmitters 588 are directed at an angle within the range of about 100° to about 120° relative to a plane of the front surface 550 of the toilet tank 518, and an angle downward from an axis perpendicular to the front surface 550 in the range of about 55° to about 65°. A potentiometer range adjustment switch 602 allows a user to adjust this range and intensity as desired for a particular toilet fixture 510. In one embodiment, the switch 602 can adjust the usable detection range from about 12 inches to about 60 inches. Of course, different range switches can be incorporated to provide different detection ranges. When the range adjustment switch 602 is activated, a "D" will flash in the digital readout 598.

Because different toilet fixtures will have different types of flush arms 570, the amount of lift necessary from the lift handle 562 to flush a particular toilet fixture 510 may vary from toilet to toilet. An arm positioning switch 604 on the circuit board 576 allows a user to adjust the travel of the lift handle 562. After installing a new unit on an existing toilet fixture 510, the user will activate the switch 604 to cause the lift arm 562 to raise. Once the lift arm 562 raises high enough to cause the flush arm 570 to flush the toilet fixture 510, the user will release the switch 604, the lift arm 562 will return to its home position and the appropriate travel of the lift arm 562 will be set for that particular toilet fixture 510.

The system 536 includes a courtesy flush feature. The courtesy flush feature provides a courtesy flush of the toilet fixture 510 after a predetermined time after a user is detected in the detection area 600. The courtesy flush freshens the bowl 512 and removes any residue from the fixture 510. The main flush will occur when the user moves out of the detection area 600. The courtesy flush feature can be switched on or off by a courtesy flush switch 606. The courtesy flush feature is indicated as being on or off after the switch 606 is activated by either a "C" displayed in the digital readout 598 to indicate that the courtesy flush is activated, or an "F" display in the digital readout 598 to indicate that the courtesy flush is off.

A maintenance override switch 608 allows the user to prevent the automatic flush system 536 from operating. By turning the maintenance switch 608 to the off position, the transmitters 588 will not transmit the infrared signal. When the maintenance switch 608 is switched off, a display of "O . . . F . . . F" will be sequentially displayed in the digital readout 598. If an object is detected in the detection area 600 for more than 530 minutes, an "E" will be displayed in the digital readout 598 and will blink continuously indicating abnormal function of the system 536. The maintenance on/off function will reset the microprocessor 578.

When a user is detected in the detection area 600, the detector 596 will send a signal to the microprocessor 578 indicative of the detection. The microprocessor 578 will cause an LED 612 of the digital readout 598 to indicate the presence of an object, and operation of the system. Once the user is detected, the digital readout 598 will count "1 . . . 2 . . . 3 . . . 4" before starting the program sequence. If the user remains in the detection area 600 for more than four seconds, and the courtesy switch 606 has been activated on, the microprocessor 578 will cause the motor 560 to lift the lift handle 562 to flush the toilet fixture 510 for the courtesy flush. During the courtesy flush, on count "5", the digital readout 598 will display a momentary "C". The digital display will then proceed to count "6", and hold for a signal of manual flushing or departure of the user. After the count "6", and no detection of a user is detected in the detection area 600, the microprocessor 578 will activate the motor 560 to lift the lift handle 562 to operate the main flush. If a manual flush has occurred prior to the user leaving the target area, the microprocessor 578 will reset to flush only when the float switch 538 is in the "water tank is full" position. If a manual flush has courtesy flush, then the microprocessor 578 will reset to flush only when the user has left the detection area 600.

As mentioned above, the automatic flushing system 536 is operational in association with the automatic toilet seat device of the invention. A float switch connection 616 on the control board 576 provides 12 VDC to the float switch 538.

Figure 22:
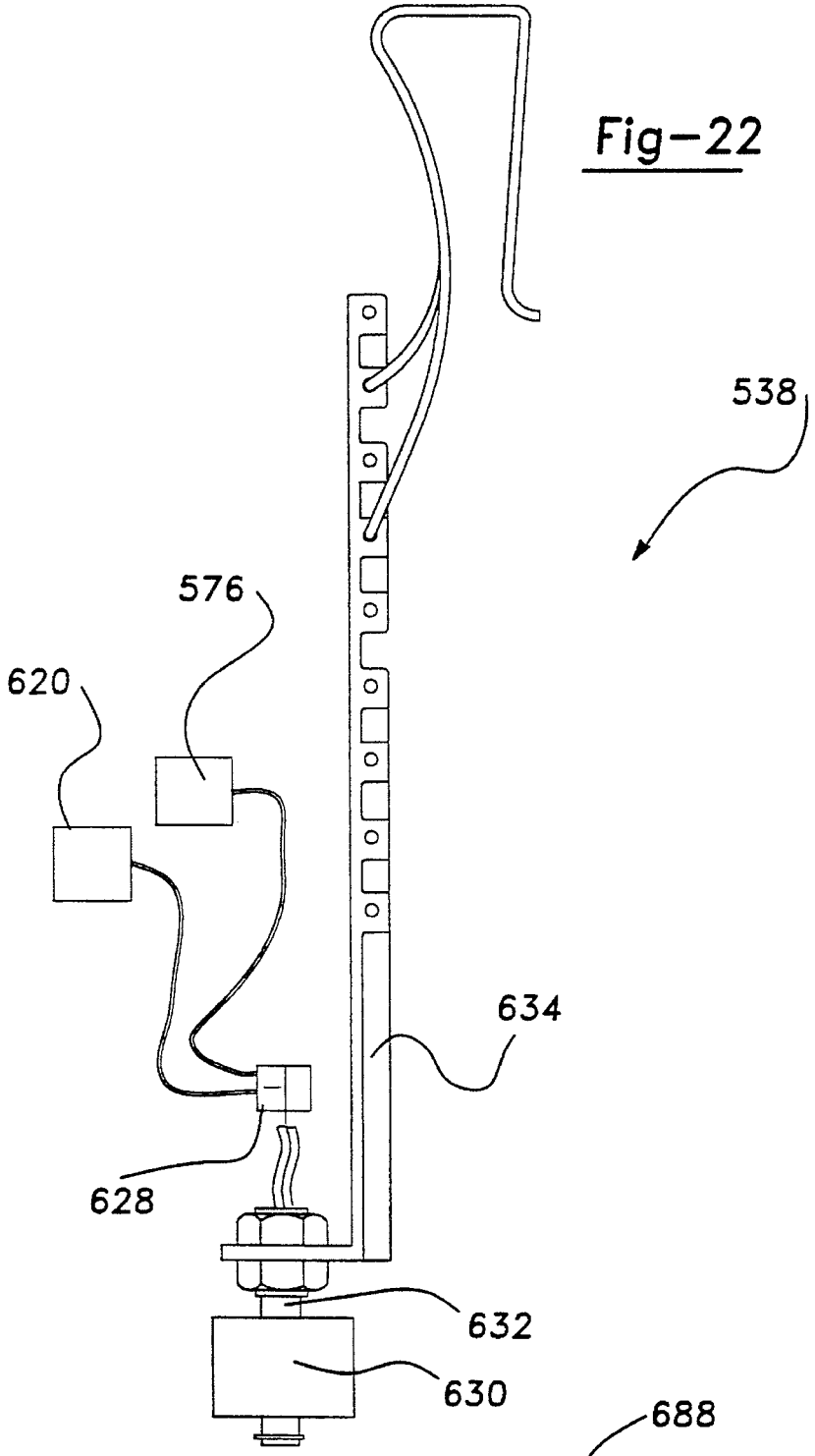
FIG. 22 shows a diagrammatic view of a float switch connected to a circuit board of an automatic flushing device and a circuit board of an automatic seat device of the invention.

FIG. 22 shows a diagrammatic view of the float switch 538 connected to the control board 576 and a control circuit 620 that is positioned within the control device 526 by a connector 628. The float switch 538 includes a floatable portion 630 which is floatable on the surface of the water within the tank 518 along a shaft 632 only when the water level is below a bottom surface of an L-shaped bracket 634. In other words, once the floatable portion 630 contacts the bracket 634 and is submerged under water, it is pinned in this location due to its buoyancy. After the toilet fixture 510 has been flushed, the floatable portion 630 will drop to its lowest level in association with the shaft 632. Once the floatable portion 630 separates from the bracket 634 in association with the water level in the tank 518, a magnet (not shown) within the floatable portion 130 causes a read switch (not shown) within the shaft 632 to be activated. The read switch will then send a signal to the control circuit 620 and the control board 576 to indicate that the toilet fixture 510 has been flushed. Alternately, the signal can be sent when the floatable portion 630 recontacts the bracket 634 after the water level rises. A float switch which operates in this fashion is commercially available from Signal Systems International of Lavalet, N.J., Model No. FS2A.

Figure 23:
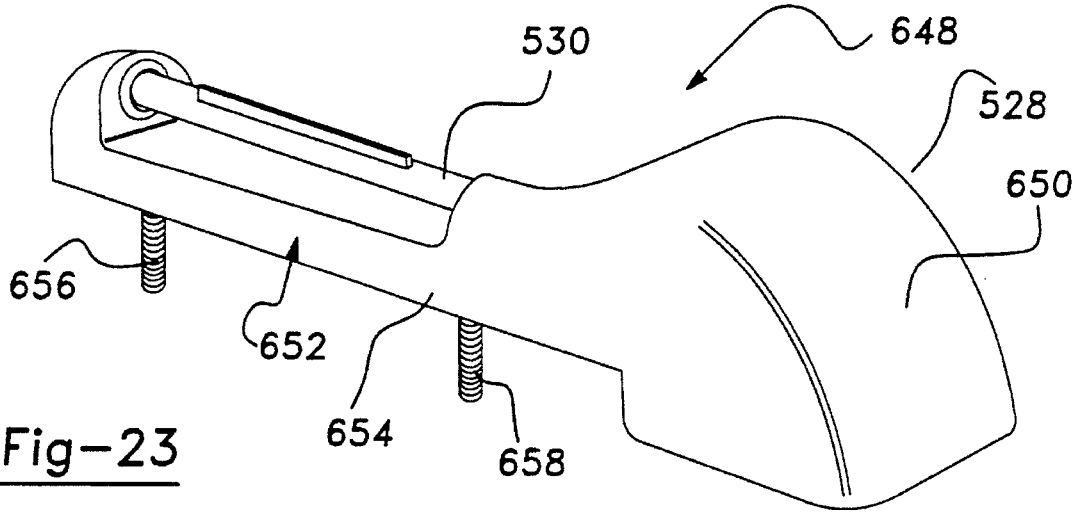
FIG. 23 shows a perspective view of a motor housing and associated fixture separated from a toilet incorporating an automatic toilet seat device according to the invention.

Now turning to FIG. 23, a seat base assembly 648 is shown separated from the toilet fixture 510. The motor housing 528 is shown having a motor housing cover 650. A fixture housing 652 having a fixture housing cover 654 extends from the motor housing 528 below the shaft 530. The toilet seat 516 and the toilet seat cover 518 are not connected to the shaft 530 in this view for clarity. A pair of fastening bolts 656 and 658 extend down from the fixture housing 652 to be connected to the toilet bowl 514 so as to secure the seat base assembly 648 to the toilet bowl 512. In this manner, the motor housing 528, the fixture housing 652, the toilet seat 514 and the toilet seat cover 516 can be a single unit.

Figure 24:
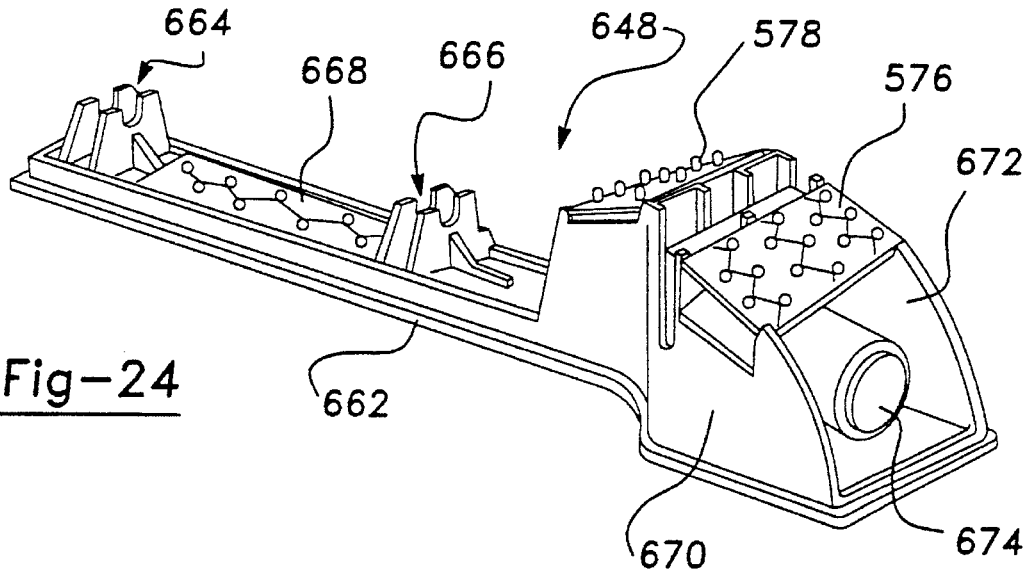
FIG. 24 shows a perspective view as in FIG. 23 with a cover of the housing removed to expose a plurality of light sources within the housing.

FIG. 24 shows the seat base assembly 648 with the housing cover 650 and the fixture cover 654 removed. As is apparent, the motor housing cover 650 and the fixture housing cover 654 are secured to a single piece base plate 662. Two pair of extending members 664 and 666 extend up from the base plate 662 within the fixture housing 652 to support the shaft 530. A light board 668 is positioned on the base plate 662 between the extending members 664 and 666. A pair of opposing side walls 670 and 672 extend up from the base plate 662 within the housing 528 to enclose an electrical motor 674 to raise and lower the seat 514. A second light board 676 is positioned on the side walls 670 and 672, as shown. A third light board 678 is also positioned within the housing 528 on the side walls 670 and 672, as shown. Of course, one or more of the light boards 668, 576 and 578 can be eliminated in alternate embodiments.

Figure 25:
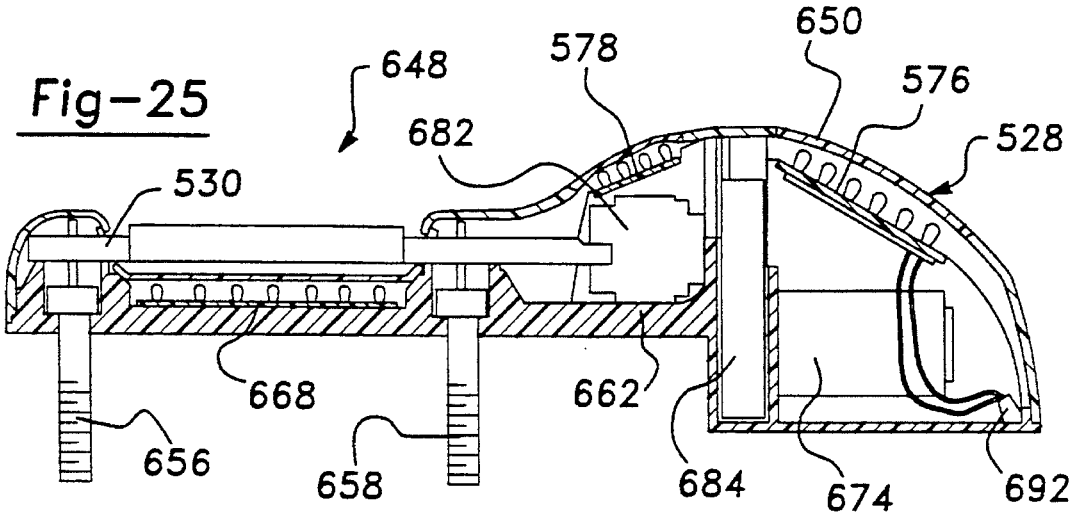
FIG. 25 is a cut-away side view of a motor housing and fixture of FIG. 23.

FIG. 25 shows a cut-away side view of the assembly 648 showing the electrical motor 674 within the housing 528 connected to the shaft 530 through a clutch 682. The cover 650 is secured to the base plate 662 to enclose the motor 674 and the clutch 682. A gear box 684 of the motor 680 is secured to the base plate 662. A motor shaft extends from the gear box 684 and is engageable with the clutch 682. When the motor 680 receives a signal from the control unit 526, the motor 680 rotates the motor shaft, which in turn causes the shaft 530 to rotate, thus lowering or raising the toilet seat 514 in association with the system commands. A more detailed discussion of the operation of raising and lowering the seat 514 in this manner can be found above.

Figure 26:
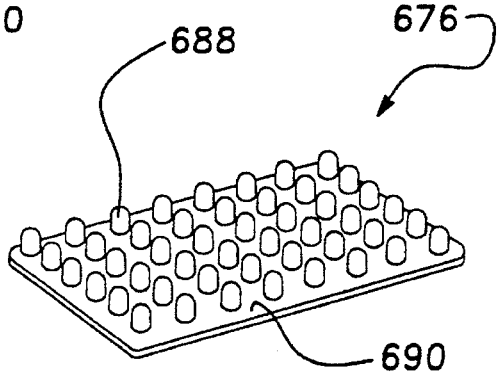
FIG. 26 shows a perspective view of one of the light sources shown in FIG. 24.

FIG. 26 shows a perspective view of the light board 676 removed from the housing 528. The other light boards 668 and 678 are of the same type as the light board 674. The light board 676 includes a plurality of symmetrically aligned LED lights 688 that provide illumination on a substrate 690. In one embodiment, the light board 676 is an LED die including a plurality of LEDs positioned on a substrate covered by an epoxy resin. A light board of this type is commercially available from Chicago Miniature Lamp, Inc. of Buffalo Groves, Ill. In one embodiment, the cover 528 is translucent to provide outward illumination from the light board 676. However, a window (not shown) can be provided in an opaque cover to provide the illumination. An ambient light sensor 692 is secured within the housing 528 to allow the light board 676 to determine when the ambient light is below an intensity that is necessary for use of the light display. In one embodiment, there are 48 LED lights 688, and the board 676 has dimensions of 2" by 3".

Figures 27, 28:
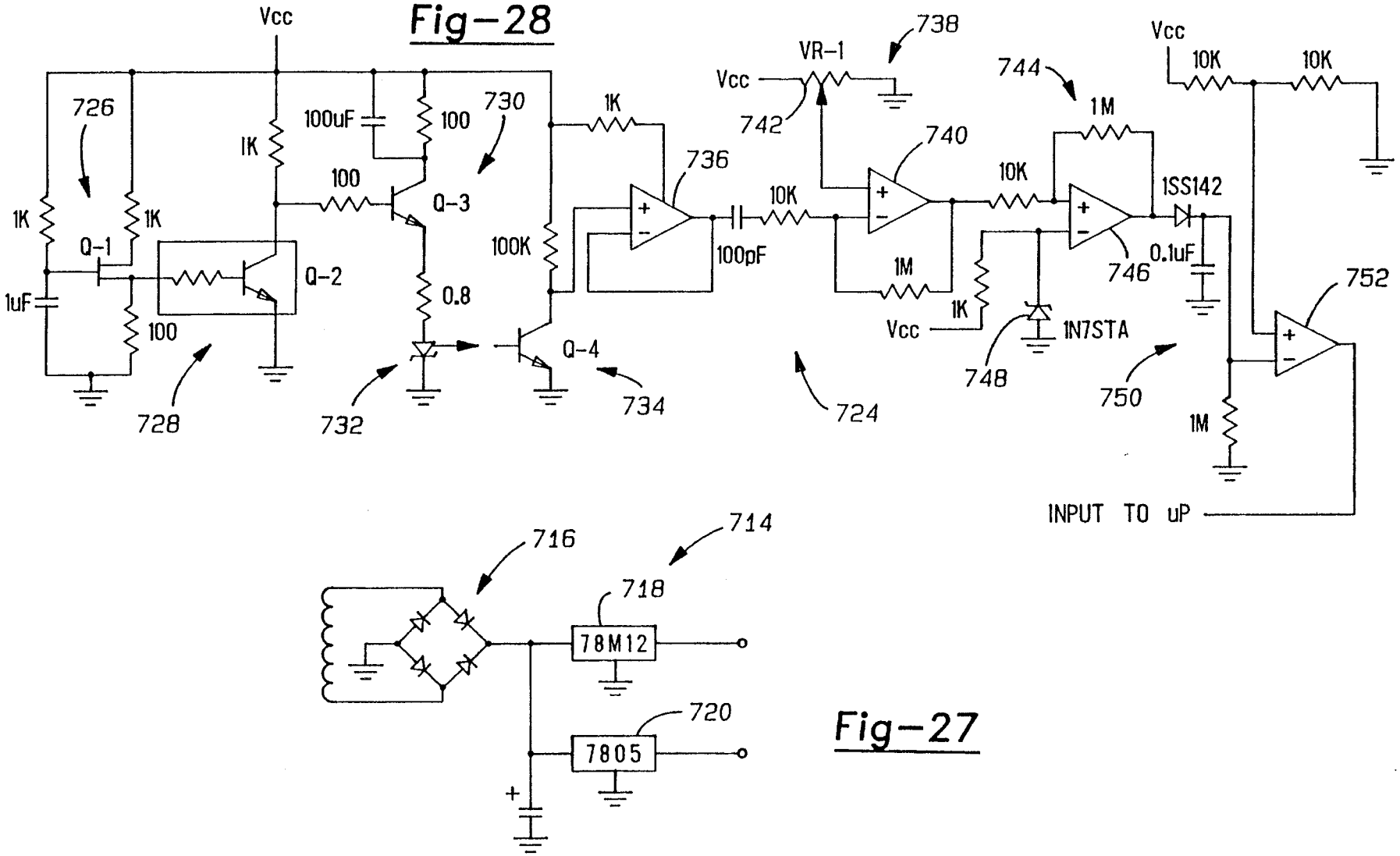
FIG. 27 shows a schematic diagram of a power supply circuit of the automatic flushing system of the invention.
FIG. 28 shows a schematic diagram of a sensor circuit of the automatic flushing system of the invention.
Figure 29:
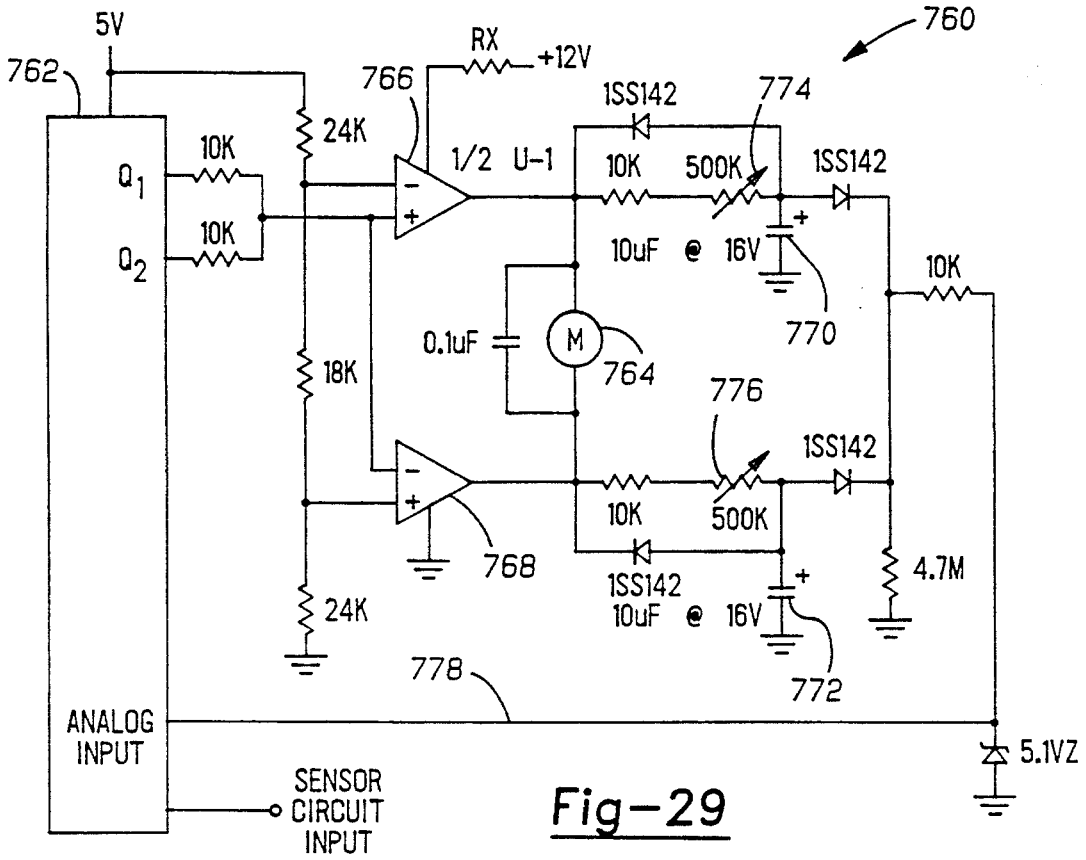
FIG. 29 shows a schematic diagram of a motor drive circuit of the automatic flushing system of the invention.

FIG. 27 shows a schematic diagram of a power supply circuit 714 that includes a bridge rectifier circuit 716, a three terminal voltage regulators 718 that provide 12 v and a three terminal voltage regulator 720 that provides 5 v. The circuit 714 provides 5 v and 12 v power to the various components of the printed circuit board 576.

Now turning to FIG. 28, a schematic diagram of a sensor circuit 724 of the printed circuit control board 576 is shown. The circuit 724 includes an oscillator circuit 726 formed by a transistor Q-1 and surrounding resistors and a capacitor that oscillates, for example at 1 Hz. An output of the oscillator circuit 726 is a short duration spike that is amplified by a first amplifier circuit 728 including a transistor Q-2 and associated amplifier components, and a second amplifier circuit 730 including a transistor Q-3, and associated amplifier components as shown. An output of the amplifier circuit 730 drives an infrared LED 732 to provide the transmitted infrared beam. The infrared LED 732 is an SIR 381 series infrared transmitter available from the Rohm Corporation in this embodiment. However, as will be appreciated by those skilled in the art, other infrared transmitters may also be applicable. Although there is a single infrared source shown in the sensor circuit 724, it will be understood that there may be a plurality of such LEDs for a particular application, as described above.

Reflected infrared radiation, emitted from the LED 732 and reflected, for example, from a user in the target location 600, is detected by an infrared transistor sensor 734. The detector 734 is an RPT 38PB3F detector, also available from the Rohm Corporation, but can be any suitable infrared detector for the purposes described herein. The detector 734 generates a voltage signal indicative of the intensity of the received infrared radiation, and applies this signal to a buffer amplifier 626 so as to separate the signal from circuit noise. The buffered voltage signal from the buffer amplifier 736 is then applied to an amplifier circuit 738 including an operational amplifier 740. The amplifier circuit 738 further includes a potentiometer switch 742, that represents the range adjustment switch 602, so as to adjust the range of the sensing circuit 684 in a manner as discussed above. The switch 742 increases or reduces the amplification of the operational amplifier 740.

An output of the amplifier circuit 738 is applied to a comparator circuit 744. The comparator circuit 744 includes an operational amplifier 746 acting as a comparator. The comparator circuit 744 prevents signals from passing that are below a predetermined threshold level as set by a zener diode 748. Therefore, the circuit 724 can be calibrated to only act on signals above a predetermined threshold that is determined by a reflection intensity from a user. An output from the comparator circuit 744 is applied to an output amplification circuit 750 that acts as a pulse stretcher. The output amplification circuit 750 includes an operational amplifier 752 that stretches the pulse from the comparator circuit 744 to provide a clean, long duration pulse that is subsequently applied to the microprocessor 578 as a sensor input signal.

In this embodiment, each of the operational amplifiers 736, 740, 746 and 752 can be LM324 type quad-operational amplifiers or BA10324 Rohm Corporation amplifiers, or any suitable operational amplifiers for the purposes described herein. Also Q-1 can be a 2N4871 WT, Q-2 can be a DTC 114TS, and Q-3 can be a 2SB1307.

When the microprocessor 578 receives the sensor input signal from the circuit 724, the microprocessor 578 may cause the motor 560 to be activated consistent with the description above. FIG. 16 shows a schematic view of a motor drive circuit 760 that would be configured on the printed circuit board 576. In the circuit 522, the microprocessor 578 is represented as a microprocessor 762. When the microprocessor 762 receives an appropriate input signal from the sensor circuit 724, the microprocessor 762 outputs signals $Q_1$ and $Q_2$ to activate a motor 764 in a desirable manner. The motor 764 represents the flush motor 560 discussed above. The microprocessor 762 controls the operation of the motor 764 from the output signals $Q_1$ and $Q_2$ based on three possible states. These states are when both $Q_1$ and $Q_2$ are 5 v (high), $Q_1$ is 0 v (low) and $Q_2$ is 5 v (high), and both $Q_1$ and $Q_2$ are 0 v (low). These three different states cause the motor 560 to either raise the lift arm 562, lower the lift arm 562, or remain stationary. Because each of the outputs $Q_1$ and $Q_2$ are tied to a separate 10K ohm resistor and a common output line, the three different output states provide three different output voltage levels on the common output line, namely 0 v, 2.5 v and 5 v. For this embodiment, a 0 v (low) output causes the motor 764 to rotate in one direction, a 2.5 v output causes the motor 764 to stop, and a 5 v output causes the motor 764 to rotate in the opposite direction.

The combined output signal from the output signal $Q_1$ and $Q_2$ is applied to opposite input poles of first and second operational amplifiers 766 and 768, as shown. The other input of the operational amplifiers 766 and 768 is a voltage divided signal from a 24K and 18K resistor. This configuration allows the dual operational amplifiers 766 and 768 to respond to the three different voltage levels. For motor travel in one direction, the outputs of the operational amplifiers 766 and 768 are opposite in states, that is, one is high and one is low. The reverse is true for travel in the opposite direction. For the stop command, both of the outputs of the operational amplifiers 766 and 768 are low.

The output signals from the operational amplifiers 766 and 768 each charge separate 10 μF capacitors 770 and 772, respectively, through a 10K ohm resistor and a 500K ohm adjustable potentiometer 774 and 776, respectively. The combination of the potentiometers 734 and 736 represents the arm positioning switch 604, above, to set the travel of the arm 562. The time it takes to charge the capacitors 770 and 772 is dependent upon the setting of the potentiometers 774 and 776, respectively. In this embodiment, the potentiometers 774 and 776 allow the capacitors 770 and 772 to be charged anywhere within the range of 0.2 seconds to about 5 seconds. Once the capacitors 770 and 772 have become charged, the microprocessor 762 recognizes that the travel of the lift arm 562 is complete, as represented by an analog input signal on line 778. The microprocessor 762 then outputs a "stop" command on the outputs $Q_1$ and $Q_2$ to stop the operation of the motor 764. The capacitors 770 and 772 therefore become discharged waiting for the next command from the microprocessor 762.

Figure 30:
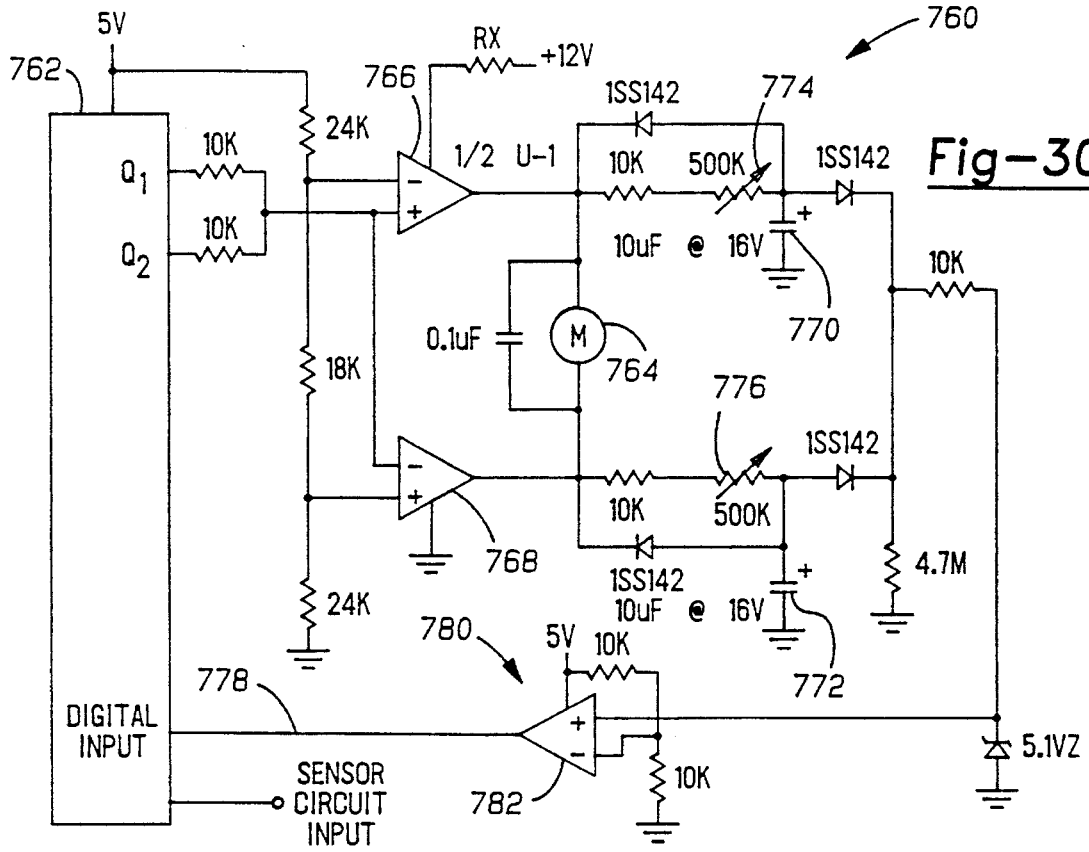
FIG. 30 shows a schematic diagram of an alternative motor drive circuit of the invention.

FIG. 30 shows the motor drive circuit 760 including an analog-to-digital converter circuit 780 that is responsive to the analog output signals from the operational amplifiers 766 and 768. The analog-to-digital converter circuit 780 includes an operational amplifier 782 and associated circuit components that convert the analog signal to a digital output signal to be applied to the microprocessor 762.

Figure 31:
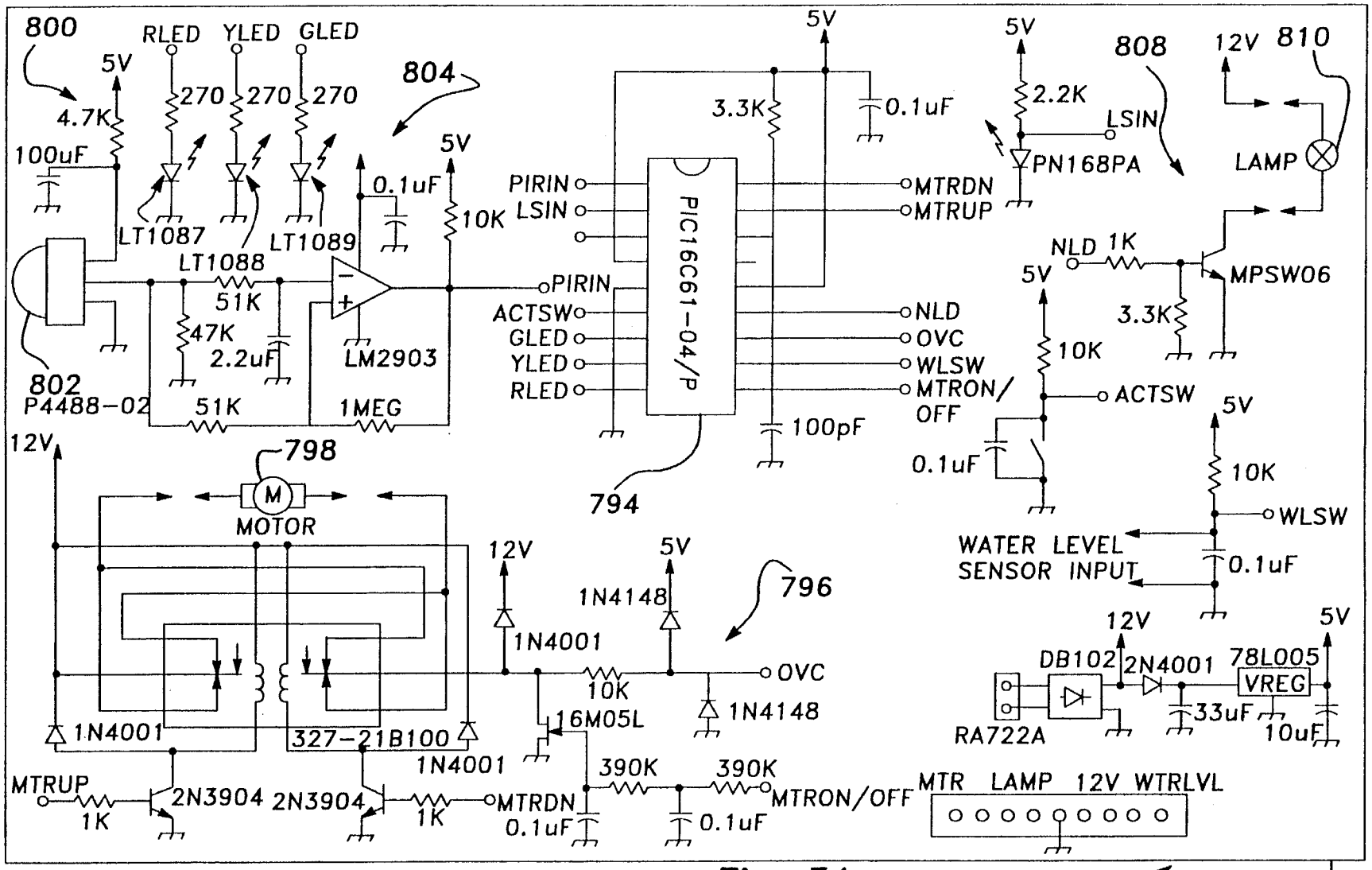
FIG. 31 shows a schematic diagram of the control circuit of the automatic toilet seat device of the invention.

Turning to FIG. 31 a schematic diagram 790 of a printed circuit board 792 that is associated with the control device 526, and controls the operation of the automatic seat device is shown. The circuit 790 is microprocessor controlled by a microcontroller 794. The microcontroller 794 is the same as or similar to the microcontroller 410, discussed above. The circuit 790 includes a motor circuit 796 having a motor 798 representing the motor 674, above. The operation of the motor circuit 796 is the same as, or nearly the same as, the motor circuit discussed above for the motor 412.

The circuit 790 includes a sensor circuit 800 including an infrared sensor 802. The infrared sensor 802 detects the user's hand within the sensing area and sends a signal indicative of the user's hand to the microcontroller 794. A series of three LED seat status lights 804 give an indication of system operation. In one embodiment, the seat status lights 804 include a red, yellow and green LED light, where the red light indicates that the seat 514 is up, the yellow light indicates that a transition is in progress, and the green light indicates that the seat 514 is down.

The microcontroller 794 can be programmed to automatically raise or lower the seat 514 when a flush occurs. This programming change can be done by pressing a button associated with the circuit 790 and connected to the microcontroller 794 for a period of, for example, 5 seconds. After the 5 seconds, two of the seat status lights 804 will light up. This will confirm that a seat home position has changed. Change in the seat home position of the seat 514 to home up or home down will be allowed to occur any time convenient to the user.

The schematic diagram 790 also includes a lamp circuit 808 including a lamp 810. The lamp 810 represents one or more of the light boards 668, 674, and 678. The lamp 810 can be programmed by the microcontroller 794 to automatically come on when no ambient light exists or low ambient light exists, to stay on continually, or stay off continually by activating a push button switch associated with the lamp circuit 808. This push button switch will be held down for 10 seconds, in one embodiment, to allow program changes of the lamp operation. After this period, two of the seat status lights 804 will come on to show the change.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A system for automatically flushing a toilet of the tank type, said system comprising:

at least one radiation beam transmitter, said radiation beam transmitter emitting a radiation beam to a target area in front of the toilet;

a radiation beam detector, said radiation beam detector being responsive to a reflected radiation beam emitted from the radiation beam transmitter and reflected off of a user in the target area;

a controller responsive to a signal from the radiation beam detector indicative of the intensity of the reflected beam;

a flush motor responsive to a signal from the controller; and a lift arm actuatable by activation of the motor, said lift arm engaging a flush arm within a toilet tank of the toilet so as to cause the flush arm to flush the toilet; and, a lift arm adjustment switch, said lift arm adjustment switch operable to set the travel of the lift arm so as to be calibrated to the flush arm.

2. The system according to claim 1 wherein the at least one radiation beam transmitter is a plurality of infrared transmitters, and the radiation beam detector is an infrared detector.

3. The system according to claim 1 further comprising a courtesy flush switch, said courtesy flush switch operable to activate a courtesy flush sequence, said controller activating the courtesy flush sequence upon detection of the user for a predetermined period of time.

4. The system according to claim 1 further comprising a range adjustment switch, said range adjustment switch operable to adjust the intensity of the at least one radiation beam transmitter so as to adjust the position of the target area.

5. The system according to claim 1 further comprising a digital readout, said digital readout providing a visual indication of system operation.

6. The system according to claim 1 further comprising a maintenance switch, said maintenance switch being operable to prevent the system from automatically flushing the toilet.

7. The system according to claim 1 wherein the flush motor is a sealed motor positioned within a motor housing.

8. The system according to claim 1 wherein the lift arm engages the flush arm at a position below the flush arm so as to allow the flush arm to manually flush the toilet in response to manual activation of a flush handle positioned on an outside of the toilet tank.

9. A system for automatically flushing a toilet of the tank-type, said system comprising:

at least one infrared radiation beam transmitter, said at least one infrared radiation beam transmitter emitting a radiation beam to a target area in front of the toilet;

an infrared radiation beam detector, said infrared radiation beam detector being responsive to a reflected radiation beam emitted from the radiation beam transmitter and reflected off of a user in the target area;

a controller being responsive to an electrical signal from the radiation beam detector indicative of the intensity of the reflected beam;

a digital read-out being responsive to signals from the controller, said digital read-out providing a visual indication of the operation of the system, wherein the at least one radiation beam transmitter, the radiation beam detector, the controller and the digital read-out are configured on a common circuit board positioned within a housing adapted to be attached to a tank of the toilet;

a flush motor responsive to a signal from the controller, said flush motor being positioned within a portion of the housing; and a lift arm actuatable by activation of the flush motor in response to the signal from the controller, said lift arm extending from the housing within the tank and engaging a flush arm within the toilet tank so as to cause the flush arm to flush the toilet, said lift arm engaging below the flush arm so as to allow the flush arm to flush the toilet in response to manual activation of a flush handle on the outside of the tank; and, a lift arm adjustment switch configured on the circuit board, said lift arm adjustment switch operable to set the travel of the lift arm so as to calibrate to the flush arm.

10. The system according to claim 9 further comprising a courtesy flush switch configured on the circuit board, said courtesy flush switch operable to activate a courtesy flush sequence, said controller activating the courtesy flush sequence upon detection of the user within the target area for a predetermined period of time.

11. The system according to claim 9 further comprising a range adjustment switch configured on the circuit board, said range adjustment switch operable to adjust the intensity of the at least one infrared radiation beam transmitter so as to adjust the position of the target area.

12. The system according to claim 9 further comprising a maintenance switch configured on the circuit board, said maintenance switch being operable to prevent the system from automatically flushing the toilet.

13. A touchless control system for a tank-type toilet, said system comprising:

an automatic flushing system, said automatic flushing system including a radiation beam transmitter and a radiation beam detector positioned to detect a system user in a target area in front of the toilet, said automatic flushing system further including a flush motor responsive to a signal from a controller so as to actuate a lift arm positioned within a tank of the toilet to engage a flush arm within the tank so as to cause the flush arm to flush the toilet; and an automatic toilet seat system, said automatic toilet seat system automatically raising or lowering a toilet seat of the toilet in response to a flush from the automatic flushing system, said automatic toilet seat system including a float switch adapted to be positioned within the toilet tank of the toilet for providing a flush signal in response to a flush of the toilet, said controller being responsive to a flush signal from the float switch for actuating said toilet seat device.

14. The system according to claim 13 wherein the automatic toilet seat system includes a toilet seat motor adapted to be connected to a toilet seat shaft, said toilet seat motor being responsive to a control signal to rotate the shaft and cause the toilet seat to be raised or lowered.

15. The system according to claim 14 wherein the toilet seat motor is positioned within the housing adjacent to the toilet seat.

16. The system according to claim 15 further comprising at least one light source positioned within the housing adjacent to the toilet seat motor.

17. A system for automatically flushing a toilet of the tank type, said system comprising:

at least one radiation beam transmitter, said radiation beam transmitter emitting a radiation beam to a target area in front of the toilet;

a radiation beam detector, said radiation beam detector being responsive to a reflected radiation beam emitted from the radiation beam transmitter and reflected off of a user in the target area;

a controller responsive to a signal from the radiation beam detector indicative of the intensity of the reflected beam;

a flush motor responsive to a signal from the controller;

a lift arm actuatable by activation of the motor, said lift arm engaging a flush arm within a toilet tank of the toilet so as to cause the flush arm to flush the toilet;

an automatic toilet seat device, said automatic toilet seat device automatically raising or lowering a toilet seat of the toilet in response to a flush from the system; and, a float switch adapted to be positioned within the toilet tank of the toilet for providing a flush signal in response to a flush of the toilet, said controller being responsive to said flush signal from the float switch for actuating said toilet seat device.

18. The system according to claim 17 wherein the automatic toilet seat device includes a toilet seat motor adapted to be connected to a toilet seat shaft, said toilet seat motor being responsive to a control signal to rotate the shaft and cause the toilet seat to be raised or lowered.

19. The system according to claim 18 wherein the toilet seat motor is positioned within a housing adjacent to the toilet seat.

20. The system according to claim 19 further comprising at least one light source positioned within the housing adjacent to the toilet seat motor.

21. The system according to claim 20 wherein the at least one light source is an LED die including a plurality of LED light sources.

* * * * *